US007901282B2

(12) United States Patent
Cannon

(10) Patent No.: US 7,901,282 B2
(45) Date of Patent: Mar. 8, 2011

(54) GAMING DEVICE HAVING COMPETITIVE/BONUS MATCHING GAME

(75) Inventor: Lee E. Cannon, Bozeman, MT (US)

(73) Assignee: IGT, Reno, NV (US)

( * ) Notice: Subject to any disclaimer, the term of this patent is extended or adjusted under 35 U.S.C. 154(b) by 615 days.

(21) Appl. No.: 11/457,707

(22) Filed: Jul. 14, 2006

(65) Prior Publication Data

US 2008/0026813 A1 Jan. 31, 2008

(51) Int. Cl.
*A63F 9/24* (2006.01)

(52) U.S. Cl. ..... 463/18; 463/16; 463/17; 273/138.1; 273/139; 273/273

(58) Field of Classification Search ..... 463/16–23, 463/25–26, 33; 273/137, 138.1, 139, 269, 273/273, 138.2, 148 R, 460–461; *A63F 9/24*
See application file for complete search history.

(56) References Cited

U.S. PATENT DOCUMENTS

| | | | |
|---|---|---|---|
| 3,533,629 | A | 10/1970 | Raven et al. |
| 4,033,588 | A | 7/1977 | Watts |
| 4,157,829 | A | 6/1979 | Goldman et al. |
| 4,335,809 | A | 6/1982 | Wain |
| 4,339,798 | A | 7/1982 | Hedges et al. |
| 4,467,424 | A | 8/1984 | Hedges et al. |
| 4,494,197 | A | 1/1985 | Troy et al. |
| 4,582,324 | A | 4/1986 | Koza et al. |
| 4,652,998 | A | 3/1987 | Koza et al. |
| 4,669,730 | A | 6/1987 | Small |
| 4,689,742 | A | 8/1987 | Troy et al. |
| 4,695,053 | A | 9/1987 | Vazquez et al. |
| 4,756,531 | A | 7/1988 | DiRe et al. |
| 4,775,155 | A | 10/1988 | Lees |
| 4,805,907 | A | 2/1989 | Hagiwara |
| 4,815,741 | A | 3/1989 | Small |
| 4,817,951 | A | 4/1989 | Crouch et al. |
| 4,836,546 | A | 6/1989 | DiRe |
| 4,836,548 | A | 6/1989 | Chittenden |

(Continued)

FOREIGN PATENT DOCUMENTS

| | | |
|---|---|---|
| AU | 711501 | 10/1999 |

(Continued)

OTHER PUBLICATIONS www.MegaMillions.org, inter alia, Dec. 24, 2003, see in full and attached drawings.*

(Continued)

*Primary Examiner* — Peter DungBa Vo
*Assistant Examiner* — Arthur O. Hall
(74) *Attorney, Agent, or Firm* — K&L Gates LLP

(57) ABSTRACT

A gaming device including a display device, a plurality of different symbols displayable by the display device, a processor, an input device operable with the processor to enable a player to pick a number of the different symbols for the play of the game, the processor configured for said play of the game to cause a number of different symbols to be picked by the game, cause at least one symbol from the plurality of different symbols to be drawn for matching, count a first amount of like player-picked symbols and processor drawn symbols, count a second amount of like game-picked symbols and processor drawn symbols, and provide an award if any to the player based on a difference between the first amount and the second amount.

25 Claims, 13 Drawing Sheets

U.S. PATENT DOCUMENTS 4,842,278 A 6/1989 Markowicz
4,856,787 A 8/1989 Itkis
4,982,337 A 1/1991 Burr et al.
4,991,848 A 2/1991 Greenwood et al.
5,042,809 A 8/1991 Richardson
5,046,737 A 9/1991 Fienberg
5,092,598 A 3/1992 Kamille
5,100,139 A 3/1992 Di Bella
5,116,049 A 5/1992 Sludikoff et al.
5,116,055 A 5/1992 Tracy
5,158,293 A 10/1992 Mullins
5,242,163 A 9/1993 Fulton
5,265,874 A 11/1993 Dickinson et al.
5,275,400 A 1/1994 Weingardt et al.
5,276,312 A 1/1994 McCarthy
5,280,909 A 1/1994 Tracy
5,282,620 A 2/1994 Keesee
5,324,035 A 6/1994 Morris et al.
5,342,047 A 8/1994 Heidel et al.
5,344,144 A 9/1994 Canon
5,393,057 A 2/1995 Marnell, II
5,398,932 A 3/1995 Eberhardt et al.
5,401,024 A 3/1995 Simunek
5,407,199 A 4/1995 Gumina
5,476,259 A 12/1995 Weingardt
5,482,289 A 1/1996 Weingardt
5,536,016 A 7/1996 Thompson
5,586,937 A 12/1996 Menashe
5,611,730 A 3/1997 Weiss
5,628,684 A 5/1997 Bouedec
5,639,089 A 6/1997 Matsumoto et al.
5,645,486 A 7/1997 Nagao et al.
5,647,798 A 7/1997 Falciglia
5,664,998 A 9/1997 Thomas et al.
5,674,128 A 10/1997 Holch et al.
5,718,631 A 2/1998 Invencion
5,720,483 A 2/1998 Trinh
5,727,786 A 3/1998 Weingardt
5,755,619 A 5/1998 Matsumoto et al.
5,779,545 A 7/1998 Berg et al.
5,788,573 A 8/1998 Baerlocher et al.
5,800,269 A 9/1998 Holch et al.
5,833,537 A 11/1998 Barrie
5,851,148 A 12/1998 Brune et al.
5,855,515 A 1/1999 Pease et al.
5,871,398 A 2/1999 Schneier et al.
5,882,261 A 3/1999 Adams
5,902,184 A 5/1999 Bennett et al.
5,909,875 A 6/1999 Weingardt
5,935,002 A 8/1999 Falciglia
5,944,606 A 8/1999 Gerow
5,947,820 A 9/1999 Morro et al.
5,949,042 A 9/1999 Dietz, II et al.
5,954,582 A 9/1999 Zach
5,970,143 A 10/1999 Schneier et al.
5,971,849 A 10/1999 Falciglia
5,980,384 A 11/1999 Barrie
5,997,400 A 12/1999 Seelig et al.
5,997,401 A 12/1999 Crawford
6,004,207 A 12/1999 Wilson, Jr. et al.
6,012,982 A 1/2000 Piechowiak et al.
6,015,346 A 1/2000 Bennett
6,017,032 A 1/2000 Grippo et al.
6,024,640 A 2/2000 Walker et al.
6,033,306 A 3/2000 DeSouza
6,056,642 A 5/2000 Bennett
6,059,289 A 5/2000 Vancura
6,062,981 A 5/2000 Luciano, Jr.
6,079,711 A 6/2000 Wei et al.
6,089,976 A 7/2000 Schneider et al.
6,089,978 A 7/2000 Adams
6,089,982 A 7/2000 Holch et al.
6,099,408 A 8/2000 Schneir et al.
6,102,400 A 8/2000 Scott et al.
6,110,043 A 8/2000 Olsen
6,117,009 A 9/2000 Yoseloff
6,129,632 A 10/2000 Luciano
6,146,272 A 11/2000 Walker et al.
6,146,273 A 11/2000 Olsen
6,155,925 A 12/2000 Giobbi et al.
6,159,098 A 12/2000 Slomiany et al.
6,162,121 A 12/2000 Morro et al.
6,168,520 B1 1/2001 Baerlocher et al.
6,168,521 B1 1/2001 Luciano et al.
6,183,361 B1 2/2001 Cummings et al.
6,203,010 B1 3/2001 Jorasch et al.
6,203,428 B1 3/2001 Giobbi et al.
6,210,275 B1 4/2001 Olsen
6,210,276 B1 4/2001 Mullins
6,210,279 B1 4/2001 Dickinson
6,217,448 B1 4/2001 Olsen
6,220,961 B1 4/2001 Keane et al.
6,224,482 B1 5/2001 Bennett
6,224,484 B1 5/2001 Okuda et al.
6,234,897 B1 5/2001 Frohm et al.
6,241,606 B1 6/2001 Riendeau et al.
6,250,685 B1 6/2001 Walker et al.
6,254,480 B1 7/2001 Zach
6,273,820 B1 8/2001 Haste, III
6,280,328 B1 8/2001 Holch et al.
6,283,855 B1 9/2001 Bingham
6,309,298 B1 10/2001 Gerow
6,311,976 B1 11/2001 Yoseloff et al.
6,312,334 B1 11/2001 Yoseloff
6,315,291 B1 11/2001 Moody
6,325,716 B1 12/2001 Walker et al.
6,334,814 B1 1/2002 Adams
6,336,862 B1 1/2002 Byrne
6,346,043 B1 2/2002 Colin et al.
6,358,151 B1 3/2002 Enzminger et al.
6,364,313 B1 4/2002 Moody
6,368,214 B1 4/2002 Luciano
6,368,218 B2 4/2002 Angell, Jr.
6,386,977 B1 5/2002 Hole
6,398,218 B1 6/2002 Vancura
6,398,644 B1 6/2002 Perrie et al.
6,398,645 B1 6/2002 Yoseloff
6,402,614 B1 6/2002 Schneier et al.
6,419,583 B1 7/2002 Crumby et al.
6,425,823 B1 7/2002 Byrne
6,428,412 B1 8/2002 Anderson et al.
6,443,837 B1 9/2002 Jaffe et al.
6,450,885 B2 9/2002 Schneier et al.
6,454,648 B1 9/2002 Kelly et al.
6,454,650 B1 * 9/2002 Aronin ..... 463/17
6,454,651 B1 9/2002 Yoseloff
RE37,885 E 10/2002 Acres et al.
6,461,241 B1 10/2002 Webb et al.
6,464,582 B1 10/2002 Baerlocher et al.
6,471,591 B1 10/2002 Crumby
6,475,086 B2 11/2002 Zach
6,478,677 B1 11/2002 Moody
6,481,713 B2 11/2002 Perrie et al.
6,508,711 B1 1/2003 Ono
6,514,144 B2 2/2003 Riendeau et al.
6,524,184 B1 2/2003 Lind et al.
6,527,638 B1 3/2003 Walker et al.
6,533,660 B2 3/2003 Seelig et al.
6,533,664 B1 3/2003 Crumby
6,537,150 B1 3/2003 Luciano et al.
6,599,193 B2 7/2003 Baerlocher et al.
6,602,137 B2 * 8/2003 Kaminkow et al. ..... 463/16
6,609,973 B1 8/2003 Weiss
6,645,071 B2 11/2003 Perrie et al.
6,656,044 B1 12/2003 Lewis
6,702,699 B2 3/2004 Touhey et al.
6,729,961 B1 5/2004 Millerschone
6,739,970 B2 5/2004 Luciano
6,749,500 B1 6/2004 Nelson et al.
6,764,397 B1 7/2004 Robb
6,824,465 B2 11/2004 Luciano, Jr.
6,855,055 B2 2/2005 Perrie et al.
6,921,334 B1 * 7/2005 Bennett ..... 463/16
7,204,756 B2 * 4/2007 Jubinville et al. ..... 463/17
7,258,608 B2 * 8/2007 Khal ..... 463/18
7,306,519 B2 12/2007 Baerlocher
7,311,598 B2 12/2007 Kaminkow et al.

| | | | | |
|---|---|---|---|---|
| 7,311,604 | B2 | 12/2007 | Kaminkow et al. | |
| 7,500,912 | B2 * | 3/2009 | Owen | 463/13 |
| 7,641,552 | B2 * | 1/2010 | Manz | 463/37 |
| 2002/0010013 | A1 | 1/2002 | Walker et al. | |
| 2002/0058545 | A1 | 5/2002 | Luciano | |
| 2002/0072404 | A1 | 6/2002 | Gerow | |
| 2002/0082070 | A1 | 6/2002 | Macke et al. | |
| 2002/0098882 | A1 | 7/2002 | Lind et al. | |
| 2002/0098883 | A1 | 7/2002 | Packes, Jr. et al. | |
| 2002/0111214 | A1 | 8/2002 | Lind et al. | |
| 2002/0113369 | A1 | 8/2002 | Weingardt | |
| 2002/0169018 | A1 | 11/2002 | Schneier et al. | |
| 2003/0003981 | A1 * | 1/2003 | Valenti | 463/16 |
| 2003/0017867 | A1 * | 1/2003 | deKeller | 463/18 |
| 2003/0153378 | A1 * | 8/2003 | Schlegel et al. | 463/16 |
| 2003/0181231 | A1 | 9/2003 | Vancura et al. | |
| 2003/0181234 | A1 | 9/2003 | Falciglia, Sr. | |
| 2003/0193136 | A1 | 10/2003 | Walker et al. | |
| 2003/0211884 | A1 | 11/2003 | Gauselmann | |
| 2003/0236116 | A1 | 12/2003 | Marks et al. | |
| 2004/0048644 | A1 | 3/2004 | Gerrard et al. | |
| 2004/0048651 | A1 * | 3/2004 | Vorias et al. | 463/20 |
| 2004/0082376 | A1 * | 4/2004 | Baerlocher et al. | 463/16 |
| 2004/0106445 | A1 | 6/2004 | Perrie et al. | |
| 2004/0259629 | A1 | 12/2004 | Michaelson et al. | |
| 2005/0014553 | A1 | 1/2005 | Byrne | |
| 2005/0037832 | A1 | 2/2005 | Cannon | |
| 2005/0107153 | A1 * | 5/2005 | Jubinville et al. | 463/18 |
| 2005/0119047 | A1 | 6/2005 | Olive | |
| 2005/0143168 | A1 | 6/2005 | Torango | |
| 2005/0176488 | A1 | 8/2005 | Olive | |
| 2005/0209004 | A1 | 9/2005 | Torango | |
| 2005/0227753 | A1 | 10/2005 | Luciano, Jr. | |
| 2005/0239542 | A1 | 10/2005 | Olsen | |
| 2006/0040723 | A1 | 2/2006 | Baerlocher et al. | |
| 2006/0040732 | A1 | 2/2006 | Baerlocher et al. | |
| 2006/0040733 | A1 | 2/2006 | Baerlocher et al. | |
| 2006/0040734 | A1 | 2/2006 | Baerlocher et al. | |
| 2006/0040736 | A1 | 2/2006 | Baerlocher et al. | |
| 2006/0046822 | A1 | 3/2006 | Kaminkow et al. | |
| 2006/0068880 | A1 | 3/2006 | Cannon | |
| 2006/0189375 | A1 * | 8/2006 | Dodge | 463/18 |
| 2007/0054732 | A1 | 3/2007 | Baerlocher | |
| 2007/0054733 | A1 | 3/2007 | Baerlocher | |
| 2007/0077990 | A1 | 4/2007 | Cuddy et al. | |
| 2007/0117611 | A1 * | 5/2007 | Dodge | 463/18 |
| 2007/0149595 | A1 | 6/2007 | Kaminkow et al. | |
| 2007/0155485 | A1 | 7/2007 | Cuddy et al. | |
| 2007/0167217 | A1 | 7/2007 | Kaminkow et al. | |
| 2007/0178957 | A1 * | 8/2007 | Cabot et al. | 463/17 |
| 2007/0184887 | A1 * | 8/2007 | Cannon | 463/16 |

FOREIGN PATENT DOCUMENTS

| | | | |
|---|---|---|---|
| GB | 2 137 392 | | 10/1984 |
| GB | 2 374 294 | A | 10/2002 |
| WO | WO 98/35309 | | 8/1998 |
| WO | WO 00/12186 | | 3/2000 |
| WO | WO 00/67424 | | 11/2000 |
| WO | WO 02/097749 | A2 | 12/2002 |
| WO | WO 2004/014502 | A2 | 2/2004 |
| WO | WO 2005/083599 | A1 | 9/2005 |
| WO | WO 2005/099425 | A2 | 10/2005 |

OTHER PUBLICATIONS www. MegaMillions.com, see drawings enclosed.*
Alley Cat Keno Game Description, written by IGT, available prior to Sep. 12, 2002.
Believe it or Not Article written by Strictly Slots, published in 2001.
Big Top Keno Advertisement, written by Aristocrat, published Oct. 2000.
Bing Ball Bingo Advertisement, written by BCSI Corporation, published prior to 2003.
Bingo Advertisement and Jackpot Bingo Advertisement written by Casino Data Systems, published in 1998 and 2001.
Bingo Advertisement, written by Casino Data Systems, published 1998.
Bingo Advertisement, written by WMS Gaming, Inc., published prior to 2003.
Bingo Brasil Advertisement, written by Unidesa Gaming, published prior to 2003.
Bingo Game Station Advertisement, written by Cole Gaming Technologies, published prior to 2003.
Bingo Party Advertisement, written by Amatic Industries, published 2001.
Bingo Slot Advertisement, written by Unidesa Gaming, published prior to 2003.
Bingo Slots Advertisement, written by Odds on Gaming, published prior to 2003.
Bingo Wizard Advertisement, written by Applied Concepts, published 2002.
Bonus Bingo Advertisement, written by Unidesa Gaming, published prior to 2003.
Bonus Spin Diamond Fives Advertisement written by IGT, published in 1999.
Bonus Spin Red, White & Blue Advertisement written by IGT, published prior to 2000.
Boom Advertisements written by WMS Gaming, Inc., published in 1998.
California Dreams Advertisement, written by Cadillac Jack, published prior to 2003.
Canadian Bingo Advertisement, written by Unidesa Gaming, published prior to 2003.
Cash Box Advertisement written by Strictly Slots (Anchor Games/IGT), published in 2000.
Cash Express Advertisements, written by Aristocrat, published in 2002.
Cash Keno Advertisement, written by IGT, available prior to 2003.
Cleopatra Bingo Advertisement, written by IGT, published in 2000 and 2004.
Clue Advertisement written by Mikohn, available in 2001.
Diamonopoly Advertisement, written by International Gamco, Inc., published 2002.
Double Spin Five Times Pay Advertisement written by IGT, published prior to 2000.
Dual Screen Keno Machine Picture Advertisement, written by Acres Gaming, Inc., published prior to 2003.
Electronic Pull Tabs Advertisement, written by 21st Century Gaming, published prior to 2002.
Five Card Instant Bingo Advertisement written by IGT, published in 2000.
Flamingo Reno-Keno, written by Flamingo Reno, published prior to 2003.
Four Card Keno Game Screen Advertisement, written by IGT, published prior to 2001.
Free Game Keno, written by Keno-Info.com (website: www.keno-info.com/free_keno_game.html), website published 2002, printed on Aug. 11, 2002.
Full House Advertisement, written by Anchor Games, published in 2000.
Gold Fever Advertisement and Game Description written Casino Data System, published in 1997.
Gold Touch Multi-Game Advertisement, written by Cadillac Jack, published prior to 2003.
Instant Bingo Video Slots Advertisement, written by IGT, published 2002.
Instant Winner Advertisement, written by Williams/WMS Gaming, published prior to 2002.
Jackpot Carnival Hyperlink Advertisement, written by Aristocrat, published prior to 2002.
Jewel in the Crown Advertisement written by IGT, published in 2000.
Keno Advertisement, written by Cyberdyne Gaming, published prior to 2003.
Keno Advertisement, written by Odds on Gaming, published prior to 2003.
Krazy Keno/Star Spangled Keno Advertisement, written by Silicon Gaming, published 2001.
Lucky Times California Lottery Newsletter, published 1996.
Party Time Bingo Advertisement, written by Astra Games Limited, published prior to 2003.
Play it Again Advertisement, written by International Gamco, Inc., published 2000.

Pot O' Gold Advertisement, written by Vision Gaming & Technology, published prior to 2003.
Reel Bingo Advertisement, written by B Soft, published prior to 2003.
Slot Line MEGA JACKPOTS™ Advertisement written by IGT, published in 1997.
Slot Line Progressive Advertisement written by IGT, published in 1993.
Slot Line Progressive Advertisement written by IGT, published in 1994.
Slot Line Progressive Advertisement written by IGT, published in 1995.
Slot Line Temperature Rising Game Description written by IGT, published in 1998.
Southern Gold Advertisement, written by Cadillac Jack, published prior to 2003.
Super 8 Race Advertisement written by IGT, published prior to 2001.
Super Cherry Advertisement written by IGT, published in 2001.
Triple Diamond Keno Paytable, written by IGT, available prior to 2003.
Ultimate Keno Advertisement, written by Bally Gaming Systems, published 2000.
Vision Series Double Diamond Advertisement written by IGT, published prior to 2001.
Vision Series Good Times Advertisement written by IGT, published in 1999.
Vision Series Temperature Rising Advertisement written by IGT, published in 1999.

* cited by examiner

FIG. 8

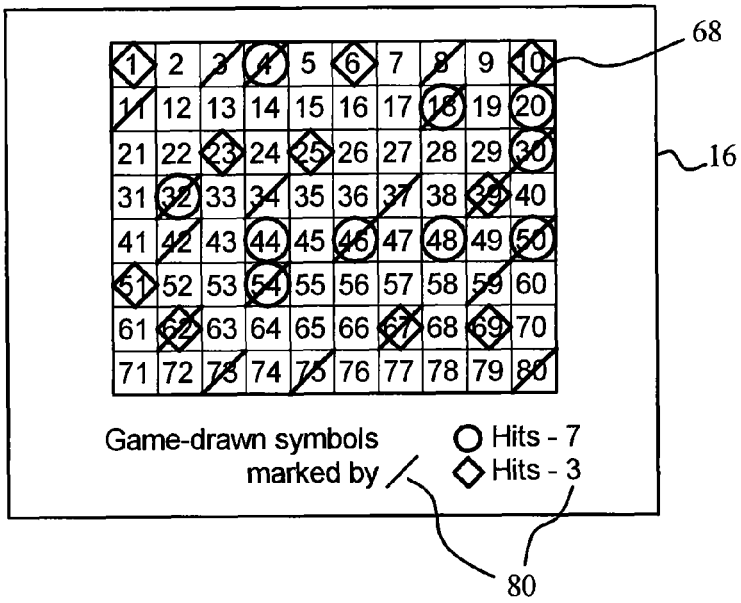

FIG. 9

Award screen / primary paytable
for ten player-pick game
For ten player picks

| # Additional Hits | Pays / coin |
|---|---|
| 2 | $10.00 |
| 3 | $50.00 |
| 4 | $100.00 |
| 5 | $500.00 |
| 6 | $1200.00 |
| 7 | $3,375.00 |
| 8 | $7,500.00 |
| 9 | $13,000.00 |
| 10 | $20,000.00 |

Your Award is $100.00/coin based on 4 additional hits.

16 84 82

FIG. 10

Award screen / base game paytable
for ten player-pick game
Primary Award is $106/coin
Bonus Award is $4.00/coin
Bonus Award Paytable

| # Additional Hits | Pays / coin |
|---|---|
| 1 | $1.00 |
| 2 | $2.00 |
| 3 | $3.00 |
| 4 | $4.00 |
| 5 | $5.00 |
| 6 | $10.00 |
| 7 | $20.00 |
| 8 | $50.00 |
| 9 | $100.00 |
| 10 | $500.00 |

Total Award is 110.00/coin based on seven total hits and four additional bonus hits.

88 86 16

FIG. 12

Paytable for ten player-pick game

16

| Player with # Additional Hits | Wins | Pays / coin |
|---|---|---|
| 2 | | $5.00 |
| 3 | | $12.00 |
| 4 | | $50.00 |
| 5 | | $500.00 |
| 6 | | $1,200.00 |
| 7 | | $3,375.00 |
| 8 | | $7,500.00 |
| 9 | | $13,000.00 |
| 10 | | $20,000.00 |

FIG. 13

Paytable for six player-pick game

16

| Player with # Additional Hits | Wins | Pays / coin |
|---|---|---|
| 1 | | $10.00 |
| 2 | | $25.00 |
| 3 | | $75.00 |
| 4 | | $300.00 |
| 5 | | $1,200.00 |
| 6 | | $5,000.00 |

FIG. 14

Paytable for two player-pick game

16

| Player with # Additional Hits | Wins | Pays / coin |
|---|---|---|
| 1 | | $10.00 |
| 2 | | $50.00 |

FIG. 15

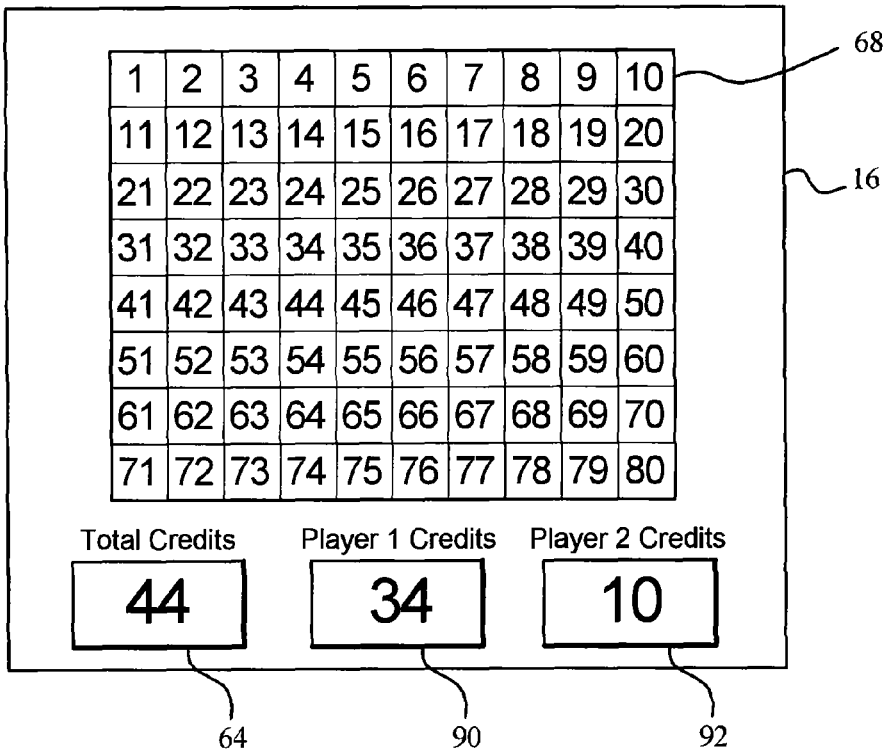

FIG. 16

Initiation

Two players play $10/per on $1 machine

Credit Meter = 20
Offset Meter = 0
Player Meter = (20 + 0)/2 =10
Player Meter = (20 - 0)/2 =10

Game Play #1

Each player wagers two credits, neither player wins

Credit Meter = 20 - 4 = 16
Offset Meter = 0 (no charge)
Player Meter = (16 + 0)/2 = 8
Player Meter = (16 - 0)/2 = 8

Game Play #2

Each player wagers two credits, player 1 has two more hits, winning 5 credits per coin Credit Meter = 16 - 4 + 10 = 22
Offset Meter = 0 + 10 = 10
Player Meter = (22 + 10)/2 = 16
Player Meter = (22 - 10)/2 = 6

Game Play #3

Each player wagers two credits, player 2 has three more hits, winning 12 credits per coin Credit Meter = 22 - 4 + 24 = 42
Offset Meter = 10 - 24 = -14
Player Meter = (42 + -14)/2 = 14
Player Meter = (42 - -14)/2 = 28

GAMING DEVICE HAVING COMPETITIVE/BONUS MATCHING GAME

BACKGROUND

The present disclosure relates in general to gaming devices, and more particularly, to new and different gaming machines and methods which employ Keno type games.

Keno in the United States traces back to a game brought to the United States by Chinese immigrants in the 1800's. The Chinese game used a board and a set of up to one hundred twenty characters instead of numbers. Early versions of American Keno used characters on the keno ticket, rather than the numbers used today. The American game dropped the number of characters to the more familiar eighty.

When gambling was legalized in the state of Nev. in 1931, the Chinese lottery game was referred to instead as Horse Race Keno, referring to the idea that the numbers are horses and the player wants the wagered horse to come in. Later, the name was shortened to simply keno, although the game is still referred to often as Horse Race Keno.

Keno is similar to a lottery game. The goal, like a lottery, is to choose a winning number or numbers from a plurality of numbers. In most versions of keno, the player receives a card with eighty squares numbered one to eighty, arranged in rows of ten. The player can bet on any number or numbers, up to fifteen numbers, which the player does by marking selected numbers on a keno card. A clerk records the player's bet(s).

The keno numbers also appear on eighty ping pong type balls, which can be tossed about in a clear plastic sphere or spun around in a wire bird cage. Keno numbers were at one time drawn using a manually powered keno goose. Later, a number of different lottery styles were used. Today, computers using random number generators generate the keno numbers. When a number is chosen, the number is shown electronically on keno boards throughout the casino.

A number of keno outlets and keno monitors are typically placed in various places around a casino or gaming establishment. In certain types of keno, the player must return a winning ticket to the keno ticket writer before the next game starts (usually about five minutes) or forfeit the win. Other types of keno allow the player additional time.

Many casinos offer multi-race cards, which allow the player to play the same set of numbers over multiple games. One type of multi game allows the player to wager a single set of numbers over as many as twenty games. When finished, the player must return to the keno station and cash in any wins. Stray and play tickets are also available to allow the player to play a version of keno called walk away keno. Here a player can purchase a keno ticket for an extended number of games, enjoy other activities in the casino and return at a later time or even a later date to have the tickets checked by a computer for winning games.

Another option for keno players is a combination or way ticket. A combination ticket enables the player to group different numbers, wherein each group has the same amount of numbers, creating more than one way to win. For example, a 3×3×3, nine spot ticket enables the player to select a combination of three groups of three numbers. The player can, for example, mark a first group of three numbers with the letter "A," mark a second group with the letter "B" and mark a third group the letter "C." This ticket enables the player to win on any winning combination of three numbers for any of the three groups. Hitting any winning combination pays as though a single ticket had been played. Essentially, the player plays three games on one card. In some keno games, playing three numbers in three games enables the player to play, or provides to the player an additional nine spot game. In one known Keno game, the player wagers on all combinations of the sets of numbers with each combination essentially being a separate wager. Thus, the player has 3 groups of 3 numbers. The player is wagering on each of the 3 groups of 3 and on each of the 3 groups of 6 formed by pairing the groups of 3, and on the group of 9 formed from all 3 of the groups of 3.

The way ticket supposedly makes keno more exciting, enabling players to wager more money on more numbers. In reality, playing a way or combination ticket offers no mathematical advantage, and no disadvantage, to the player. Some casinos offer discounted minimum bets with way tickets. If the player plays three or more ways, many casinos will discount the price per way (e.g., let the player bet $0.50 per wager instead of a usual $1 minimum). The casino however only pays back on the player's actual bet.

Known variations on keno can affect the expected return which will vary versus how many numbers are chosen. Generally, in the design of the game (selecting the pay amounts versus the number of hits for each number of picks), an effort is made for some consistency, but the nature of the math leads to some variation. It does not mathematically matter how many numbers the player chooses or if the player combines wagers. The player can choose less numbers if the player likes to win smaller amounts a little more often. The player can choose more numbers if the player does not care about the frequency of the wins and wants bigger payouts.

Providing bonuses, bonus variations and other features to existing games has increased popularity in other gaming areas, such as slot. There is a need to provide new and different Keno game implementations.

SUMMARY

The present disclosure includes two primary embodiments. The first primary embodiment provides a gaming device having a competition matching game. The second primary embodiment provides a gaming device having a matching game with a bonus feature. Each embodiment can be played with any of various different matching games, such as keno, bingo and lotto. In one embodiment, and as described in the Detailed Description below, the embodiments operate with keno. As illustrated, certain embodiments can be employed either for a primary game or a secondary game.

The competition matching game includes two main embodiments. In one main embodiment, the competition takes place between a single player and the gaming device. In another main embodiment, the competition takes place between two (or more) players. In the single player competition matching game, the player picks an amount of symbols (by picking symbols) from a field of a plurality of symbols. The gaming device makes two random generations from the field. In a first random generation, the gaming device draws the same amount of symbols from the field as picked by the player but draws different symbols than does the player. In an alternative embodiment, all of the gaming device picked symbols do not need to be different than the player picked symbols. At this point, the two competitors (single player and game) have chosen their symbols. Next, the gaming device randomly draws symbols from the entire field.

In the single player competition matching game, the gaming device makes two counts: (i) a first count of matched player-picked and game-drawn symbols; and (ii) a second count of matched game-picked and game-drawn symbols. At this point, the single player competition matching game can be played according to different implementations. In a first implementation, the first and second counts are compared for the purpose of determining the player's primary award, if any. In a second implementation, the first count is used to determine the player's primary award, if any, according to a suitable keno paytable. The second count is then used as part of a bonus game or bonus pay according to a bonus paytable.

In the multiple player competition matching game, each player picks an amount of symbols (the same amount of symbols in one embodiment) from a field of symbols. At this point, the two competitors (Player 1 and Player 2) have chosen their symbols. The gaming device randomly draws symbols from the entire field.

The multiple player competition matching game also has two main implementations, namely, one in which the competition is for a primary award and one in which the competition is for a secondary award. In the primary award implementation, the gaming device makes two counts: (i) a first count of matched Player 1-picked and game-drawn symbols; and (ii) a second count of matched Player 2-picked and game-drawn symbols. If Player 1 has a higher count than Player 2 (or a threshold level difference), Player 1 wins an award. If Player 2 has a higher count than Player 1 (or a threshold level difference), Player 2 wins an award.

In the secondary award multiple player implementation, the gaming device uses the first and second counts to determine a primary award, if any, according to a suitable keno paytable. The first and second counts are then compared with each other according to a bonus paytable to determine if either player wins a secondary or bonus award.

In both multiple player implementations, the gaming device keeps track of each player's credits according to a suitable scheme such as the one described in detail below. The gaming device keeps track of the total credits on a displayed total credit meter, which is reduced by each wager made and increased by each award generated, for either player, and for primary and secondary awards. In one embodiment, the gaming device keeps track of the difference in performance between Player 1 and Player 2 via an offset meter, which is internal to the gaming device in one embodiment. After a game play, the gaming device uses the updated credit meter and the updated offset meter to determine each player's credits displayed on a Player 1 meter and a Player 2 meter.

As mentioned above, the second primary embodiment involves a matching game with a bonus feature. Here again, the gaming device provides a field of symbols. The player picks symbols from the field of a plurality of symbols. The gaming device draws symbols from the field. A first count is made to determine how many player-picked symbols match the game-drawn symbols.

At some point in the sequence, the gaming device randomly selects a designated number of one or more symbols to be bonus symbols. In one embodiment, the gaming device makes such determination from the pool of game-drawn symbols only. In another embodiment, the gaming device makes such determination from the entire field of symbols. The amount of symbols designated can vary according to a range of possible amounts. The range can also vary according, for example, to the pool or field of symbols selected from and the amount of symbols picked by the player.

The gaming device makes a second count of how many player-picked and game-drawn hits occur via bonus symbols. The gaming device can use the first and second counts in a primary award capacity for example by awarding the player if more bonus hits than non-bonus hits are achieved. Alternatively, the gaming device can use the first count in a primary capacity according to a suitable keno and the first and second counts in a secondary award capacity for example by awarding the player if more bonus hits than non-bonus hits are achieved. Alternatively, the gaming device uses the first and second counts to determine if the player plays a separate bonus game.

It is therefore an advantage of the present disclosure to provide an improved wagering game.

Another advantage of the present disclosure is to provide an improved matching game.

It should be appreciated that although the multiple player embodiments are discussed in relation to a gaming device, more than one gaming devices in communication with each other or a central controller processor or server can be employed to provide the apparatus and the method of these embodiments.

A further advantage of the present disclosure is to provide a wagering game having a competition aspect.

Another advantage of the present disclosure is to provide a wagering game allowing multiple players to play on one gaming machine.

A further advantage of the present disclosure is to provide a wagering game allowing multiple players to play against one another.

Another advantage of the present disclosure is to provide a wagering game having a scheme to monitor each player's credits in a multiple player wagering game.

A further advantage of the present disclosure is to provide a matching game having a bonus feature.

Moreover, it is an advantage of the examples disclosed herein to provide matching game features that can be implemented in a primary game or a secondary game.

BRIEF DESCRIPTION OF THE FIGURES

FIGS. 5, 6, 7, 8, 9 and 10 are elevation views of a display device of the gaming device illustrating various aspects of the example of the sequence of FIG. 4.

FIGS. 12, 13, 14 and 15 are elevation views of a display device of the gaming device illustrating various aspects of the example of the sequence of FIG. 11.

FIG. 16 shows results of examples of game play of the multiple player competitive matching game of FIG. 11.

DETAILED DESCRIPTION

Figure 1:
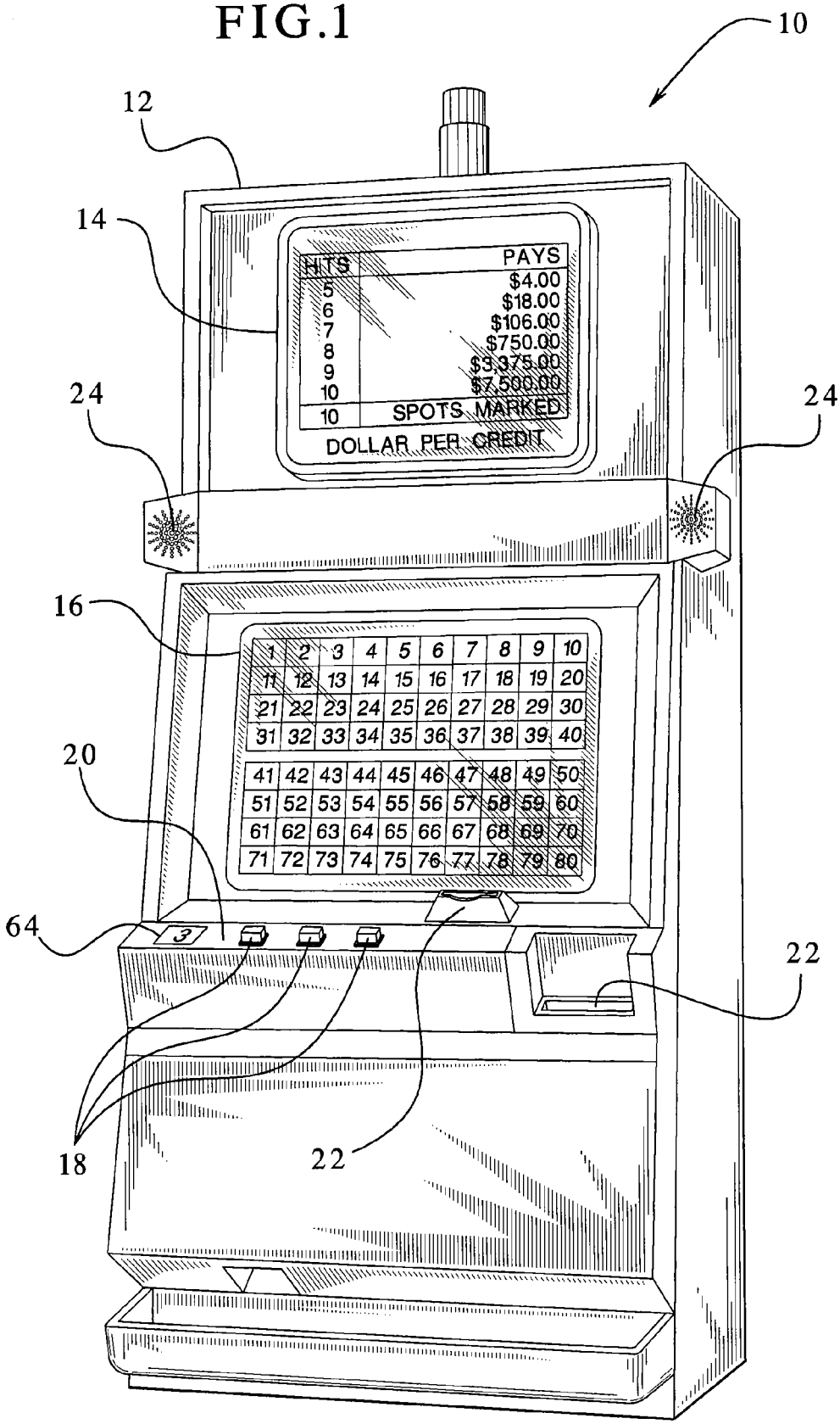
FIG. 1 is a perspective view of a gaming device incorporating the matching game examples discussed herein.

Referring now to FIG. 1, each of the embodiments described herein is provided in one embodiment in a gaming device 10. Alternatively, the embodiments are provided on various monitors throughout a casino or gaming establishment or in any other suitable manner such as through remote gaming access devices. Gaming device 10 is in one embodiment a video gaming device and includes a cabinet 12 having at least one video monitor. The illustrated embodiment includes two video monitors 14 and 16. Cabinet 12 is illustrated as being of a type where the player stands or sits. The cabinet is alternatively a bar top cabinet, wherein the player sits to play the keno game of the present disclosure.

The cabinet 12 also provides controls for a player to operate gaming device 10. In the illustrated embodiment, various electromechanical input devices 18 are provided on a tilted portion 20 of the cabinet 12, below video monitors 14 and 16. Electromechanical input devices 18 each send a discrete signal to a microprocessor located within cabinet 12. These input devices enable the player to perform the various functions, such as keno functions, including but not limited to, selecting at least one of the keno numbers, playing ways or multiple games at once, wagering a number of credits per game or way and cashing out. The input devices 18 also enable the player to play multiple keno games in a row, analogous to the multi-run or stray and play keno tickets offered by the casino. While the features of the present invention are described using the game of keno, the features are applicable to other suitable wagering matching games, such as lotto and bingo.

Similar to the electromechanical input devices 18, cabinet 12 of gaming device 10 can provide electromechanical displays that show, for example, the player's credits maintained within gaming device 10, the amount of keno numbers played, the bet per game, etc. In one embodiment, however, these functions as well as others are provided on one or more video monitor or display devices 14 and 16. In the illustrated embodiment, display device 14 shows the pays for a number of hits or matches between the numbers that the player selects and the numbers that gaming device 10 generates. Displays 14 and 16 can also inform the player of the rules concerning the operation of and the generation of free games while playing the keno game of the present invention.

Video monitor 16 displays, any one or more or all of: (i) the keno numbers randomly generated by the gaming device; (ii) the numbers played by the player; (iii) the number of ways or simultaneous games played by the player, and the numbers selected by the player for each way, (iv) the wager per game; (v) the player's total wager; (vi) one or more bonus game generations; (vii) the characters that the player may associate with the player's picks or that the game may associate with the game's picks (described below); (viii) players' individual credit amounts in a multiple player embodiment (described below); (ix) base game wins; (x) bonus game wins; and (xi) other features described herein. In one embodiment, when the player selects a number, the gaming device highlights it as a certain color, for example, yellow. When the gaming device generates a number, the gaming device highlights it as a different color, for example, blue. When a match occurs, the number is highlighted by a third color, for example, green, a combination of blue and yellow.

Cabinet 12 of gaming device 10 also includes one or more monetary input device 22. The monetary input device 22 can accept coins, cash, a smart card, a credit card, a debit card, a casino card or other type of gaming device card. Keno gaming device 10 can also include a ticket reader and a ticket printer (not illustrated) that enables the player to input and receive a redeemable ticket in lieu of cash. The ticket reader/validator and printer operate with a processor housed inside gaming device 10. Cabinet 12 or display device 16 also provides an electromechanical (as illustrated) or simulated (shown below) credit meter 64 showing the player's total credits.

Figure 2:
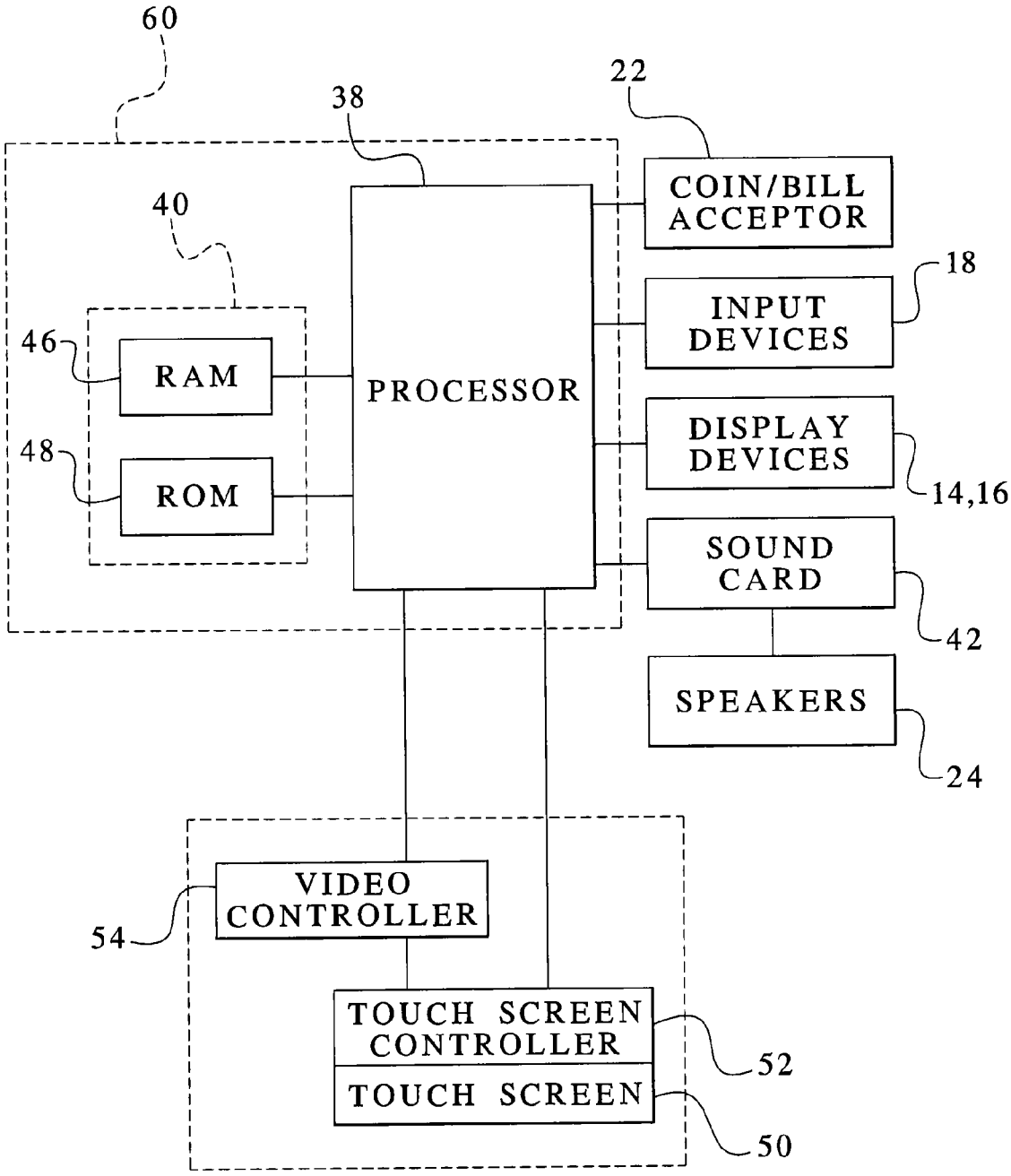
FIG. 2 is an electrical schematic for one embodiment of a gaming device employing the matching game examples discussed herein.

Referring now to FIG. 2, gaming device 10 in one embodiment is run by a processor or central processing unit ("CPU") 38 and a memory device 40 that operates with one or more display devices 14 and 16, which display the generated keno or matching numbers. Processor 38 can be a microprocessor and have a microcontroller-based platform. The memory device 40 includes random access memory ("RAM") 46 and read only memory ("ROM") 48. The platform for the processor 38 and memory device 40 can be: (i) inside gaming device 10; or (ii) as stand alone components in the casino, part of a server/client system, data network, one or more application-specific integrated circuits (ASIC's) or one or more hard-wired devices.

Gaming device 10 can house its own gaming program or be linked in a client/server manner via a data network, wherein the present invention provides some or all of the functions of the processor and memory device at a central location, such as a network server for communication to a playing station over a local area network (LAN), wide area network (WAN); Internet connection, microwave link and the like. Cabinet 12 of gaming device 10 also provides a number of speakers 24 that operate via a soundcard 42 with processor 38 to inform the player of any type of output, outcome or instruction of gaming device 10.

Gaming device 10 provides an electromechanical input device 18 or simulated input device via a touch screen 50 that operates with display device 16, a touch screen controller 52, a video controller 54 and processor 38. The input devices enable the player(s) to operate the matching gaming device 10. Any one, or more or all of video monitors 14 and 16 and speakers 24 can be used to explain: (i) the operation of the single player competitive matching game of FIGS. 4 to 10; (ii) the operation of the multiple player competitive matching game of FIGS. 11 to 16; (iii) the operation of the multiple player competitive matching game of FIG. 17; and (iv) the operation of the bonus feature matching game of FIGS. 18 to 22.

Gaming device 10 in one embodiment operates the matching games described herein as well as another type of wagering game, such as slot, poker, blackjack, craps or other suitable game. In one embodiment, the matching game is displayed on one video monitor 14, while a secondary game or paytable is displayed on the video monitor 16 or vice versa. Besides providing the matching features described herein, any of the embodiments can also provide a free or bonus slot, poker, blackjack or craps games, etc., or non-monetary awards such as a free casino beverage or meal.

The matching games described herein, whether provided in the gaming device or as a floor game, can include any suitable variation of keno, bingo, lotto or other type of matching game. For purposes of the present disclosure, the embodiments are illustrated using a variation of keno sometimes referred to as horse race or Nev. Keno. In this keno game, one or more players typically plays against the house. The keno display or card includes eighty different symbols, e.g., numbers, from which the player chooses. The player circles or marks a combination of symbols, e.g., numbers. The player decides which symbols to choose and how many to choose, usually anywhere from one to fifteen numbers in floor play and two to ten numbers for play on the gaming device.

In the casino version, the player brings a marked card to a keno clerk. The clerk records the player's numbers and issues a receipt to the player. The player finds a keno monitor and watches the numbers being posted as they are chosen. As the player watches the generation of the keno numbers, the player marks the generated numbers on the card. For an eighty number game of keno, twenty numbers are typically generated.

Figure 3:
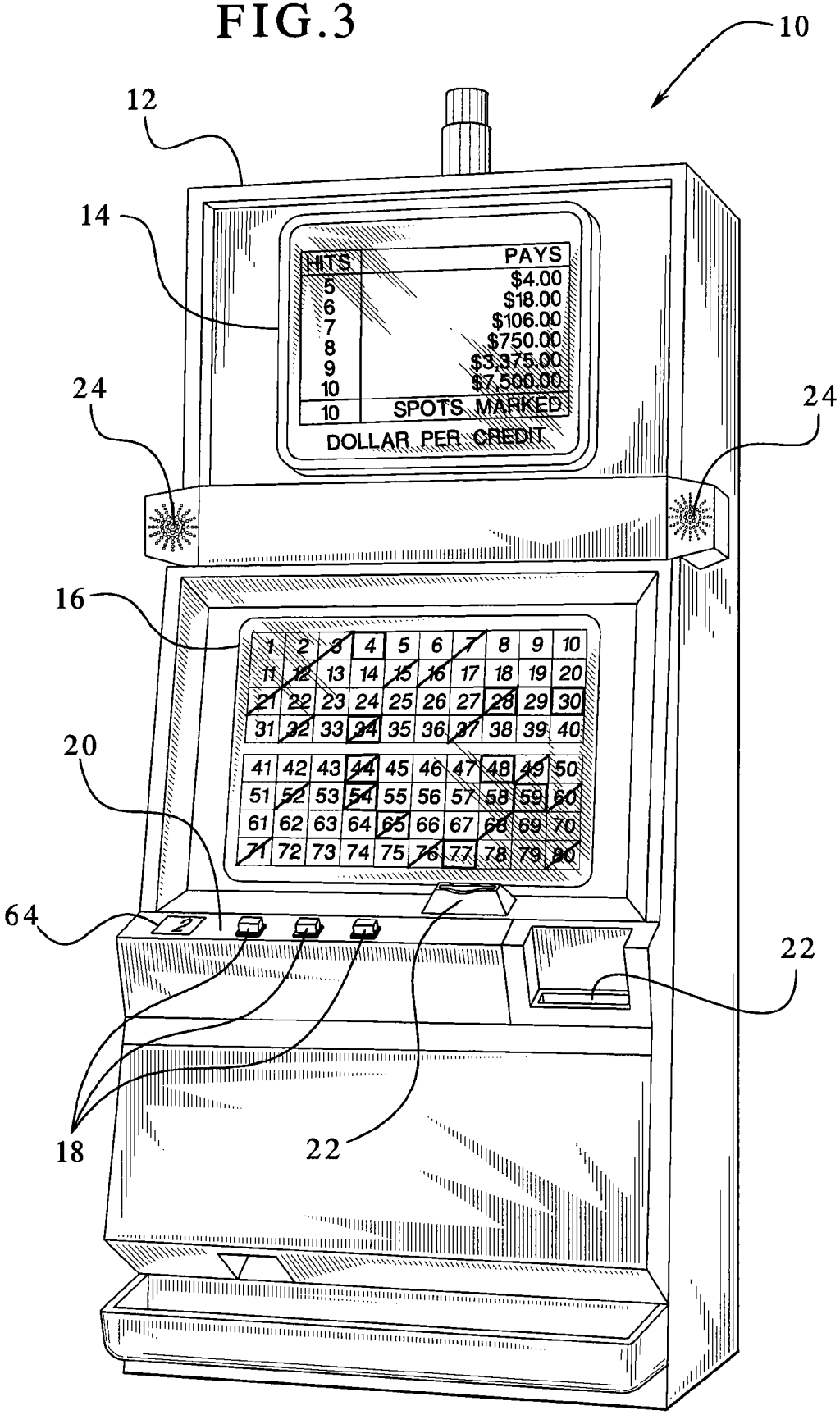
FIG. 3 is a perspective view of a gaming device showing player selected and game generated numbers.

As illustrated in FIGS. 1 and 3, with gaming device 10 the player presses one of the electromechanical pushbuttons 18 or touches the touch screen 50 that operates with display device 16 to select the ten numbers (bolded and bordered) 4, 28, 30, 34, 44, 48, 54, 59, 65 and 77. Gaming device 10 randomly selects twenty numbers (slashed-through) 3, 7, 12, 15, 16, 21, 28, 32, 34, 37, 44, 49, 52, 54, 60, 65, 68, 71, 76 and 80. There are five matches shown, namely, 28, 34, 44, 54 and 65 (bearing both markings). According to the paytable displayed in display device 14, gaming device 10 pays $4.00 per coin wagered for five matches (assuming player picks ten numbers).

With the video and casino embodiments, at the end of drawing twenty numbers, the amount of matched numbers determines: (i) whether or not player wins and (ii) how much the player wins. The greater percentage of the player's numbers that are randomly generated by the gaming device or the casino's number generator, the more the player wins. On the floor, if the player has enough matches to claim a winning ticket, which depends on how many numbers the player has selected, the player can return to the keno clerk to redeem the winning ticket.

Keno payouts vary from gaming device to gaming device and from casino to casino. For example, if the player picks five numbers, the game can require that the random generation device generate three of those five numbers for the player to receive any award. If the game generates three matches, the game usually pays the player back at three to one. However, certain gaming devices or casinos could pay back at 2.5 or 3.5 to one. If the game generates four matches for the same player pick of five numbers, the game typically pays the player back at around twenty-six to one. If the game generates all five matches, the game pays the player back at around 332 to 1.

Competition Matching Game

Figure 4:
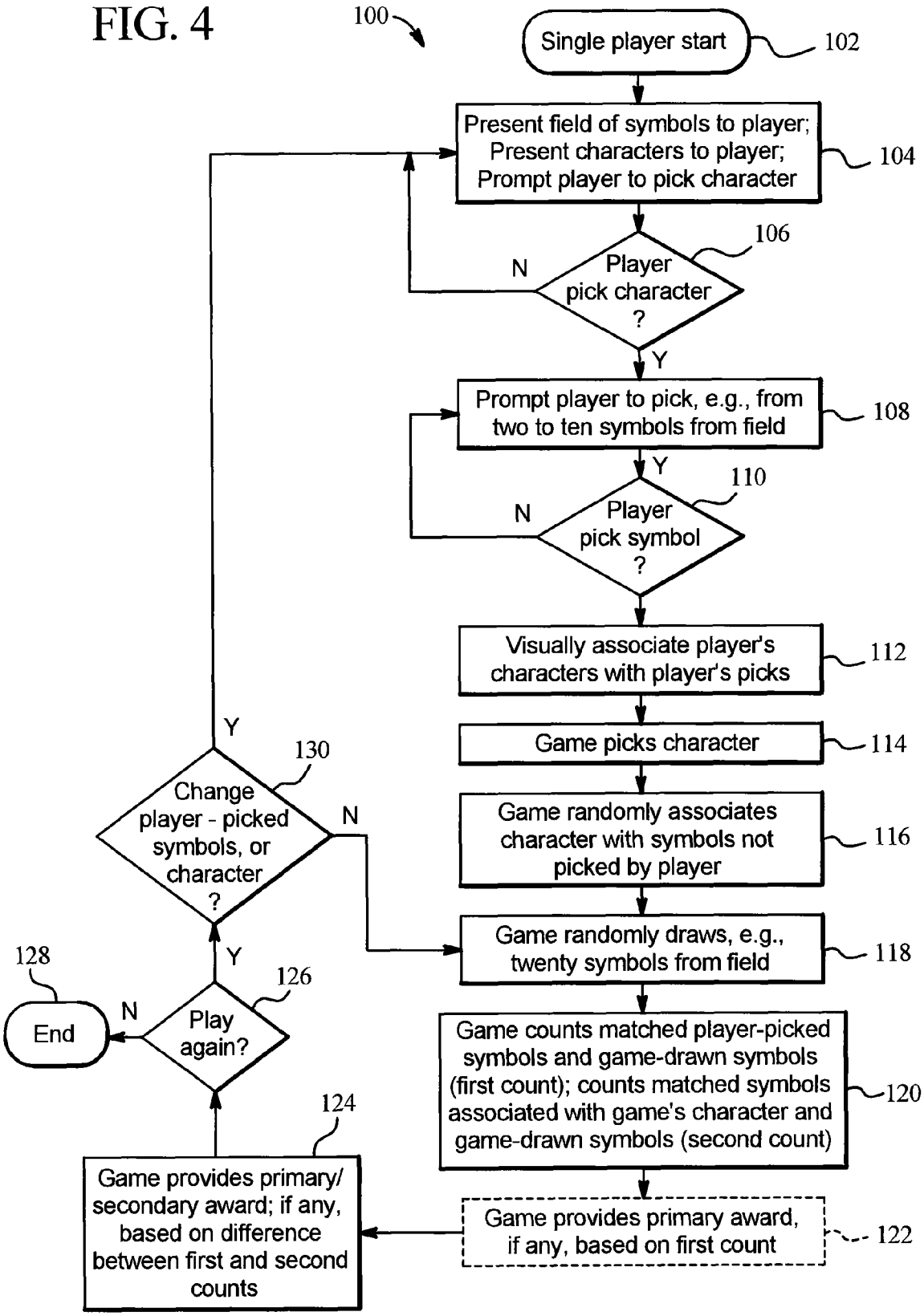
FIG. 4 is a schematic flow diagram of one embodiment of a single player competitive matching game.

Referring now to FIG. 4, one embodiment of a single player competitive matching game illustrated by sequence 100. Upon starting sequence 100 (oval 102), the gaming device presents a field of symbols, for example, the eighty numbers shown in FIGS. 1 and 3 (block 104). In one embodiment, the gaming device also presents a plurality of characters to the player, one of which the player may choose to associate with the player's picks. Examples of characters 66a to 66d are shown and described in connection with FIG. 5. The gaming device prompts the player visually and/or audibly to pick one of the characters for association with the player's picks (block 104).

The gaming device waits until the player picks a character before proceeding with the rest of sequence 100 (diamond 106). After the player picks a character, the gaming device prompts the player to pick symbols from the field of symbols (block 108). In the illustrated keno embodiment, the player in one implementation is enabled to pick from two to ten symbols from a field of eighty symbols.

The gaming device waits until the player picks the symbols before proceeding with the rest of sequence 100 (diamond 110). After the player picks the symbols, the gaming device visually associates the player's character with the picked symbols (block 112). The characters may be any suitable type of color, symbol, person, place, animal, caricature, cartoon figure, characters, foods, locations, monuments, vehicles, games sporting events, etc. The picked characters may be the same, e.g., all the same color, or different but related, e.g., players on the same sports team. In an embodiment, display 16 shows the character behind or combined with the picked symbol.

The gaming device picks one of the characters to associate with the gaming devices picks (block 114). The gaming device may provide a visual and/or audio display via video monitor 16/speakers 24 to inform the player of gaming device's selected character.

As will be seen, the gaming device makes two random selections of certain ones of the symbols. One random generation is for the competition feature of the matching game (gaming device's picks) and another for matching with the player's picks and the gaming device picks. In the first random generation, gaming device randomly picks symbols from the field that have not been picked by the player. In an alternative embodiment, the gaming device may pick one or more but preferably not all of the same numbers as the player. In one embodiment, the gaming device picks the same number of symbols that the player picks. For example if the player picks three numbers, 10, 44 and 67, from a field of eighty numbers, the gaming device also picks three numbers, but different numbers, e.g., 13, 47 and 71, from the field of eighty. The gaming device associates its character (block 114) with its picks (block 116).

Gaming device then makes the second random generation in which it draws, e.g., twenty symbols from the field of eighty symbols for the purpose of matching with the player's picks and gaming device other picks (block 118). It should be appreciated that gaming device may make the separate random determinations at any suitable time during sequence 100, in any order, or simultaneously. For purposes of description, it is logical to present the separate random generations sequentially and in the order shown.

Gaming device makes two counts (block 120). In a first count, gaming device counts the amount of matched player-picked symbols (from block 108) and gaming device drawn symbols (from block 118). In a second count, gaming device counts the amount of matched game-picked symbols (from block 116) and gaming device's drawn symbols (from block 118).

Once gaming device knows the first and second counts, sequence 100 may operate differently as desired by the game implementer (block 122 therefore shown in phantom because it may not be used). In one embodiment, the competition aspect of gaming device is provided as a secondary or bonus game played in addition to a base game such as keno. Here, gaming device provides a primary award to the player based solely on the first count, for example, according to the rules and paytable of keno (block 122), e.g., the paytable discussed above and shown in FIGS. 1 and 3. For example, if the player picks ten numbers (from block 108), six of which match with six of the gaming device's twenty drawn numbers (from block 118), the player has a base game win of $18.00 times the player's bet.

The gaming device provides a bonus or secondary award, if any, based on a difference between the first and second counts (block 124). For example, if the player picks ten numbers (from block 108), six of which match with six of the gaming device's twenty drawn numbers (from block 118), the player wins as described above. If the amount of matches (second count) between gaming device's pick of ten numbers (from block 116) and the gaming device's random draw of twenty numbers (from block 118) is more than six (or equal to six in one embodiment), the player wins no secondary award. If the player's count (first count) is greater than gaming device count (second count), the player may win a secondary award for example based on the disparity. One suitable secondary award paytable is shown and described in connection with FIG. 10.

In a further alternative embodiment, if the first count is greater than the second count by a threshold difference, e.g., three matches based on a ten symbol pick by the player, gaming device displays and plays a secondary or bonus game (e.g., theme-based or character based) leading to a bonus award. Here, the bonus game may be structured to give the player better odds to win more based on the difference between count 1 and count 2. For example, the player gets more picks of award selections for having four more matches versus three.

As discussed above, once gaming device knows the first and second counts, sequence 100 may operate differently as desired by the game implementer. In another embodiment, the competition aspect of the gaming device is provided as the primary game (block 124, block 122 not used). Here, the player's primary award, if any, is based on the difference between the first count and the second count. If the amount of matches (second count) between the gaming device's pick of ten numbers (from block 116) and device's random draw of twenty numbers (from block 118) is more than (or equal to in one embodiment) the amount of matches (first count) between the player's pick of ten numbers (from block 108) and device's random draw of twenty numbers (from block 118), the player wins no secondary award. If the player's count (first count) is greater than gaming device's count (second count), the player may win a primary award for example based on how much greater and according to a primary award paytable. One suitable primary award paytable is shown and described in connection with FIG. 9.

In any case, after any primary and possible secondary award is issued to the player, the gaming device prompts the player to decide whether to play again (diamond 126). If the player decides not to play again, the player may cash out and the game of sequence 100 ends (oval 128). If the player decides to play again, the gaming device prompts the player to decide whether to keep any one or more of: (i) the player's selected character; (ii) the player's number of picks; and (iii) the actual symbols picked. In one embodiment, a threshold value or wager may be required to play the game again. Although not illustrated, the player is also allowed to adjust the player's wager if desired. If the player decides not to change any of the three game parameters listed above, the gaming device proceeds to randomly draw, e.g., twenty numbers from the field for matching purposes (block 118) and the remaining portion of sequence 100 is repeated as described above. If the player decides to change any of the three game parameters listed above, the gaming device proceeds to prompt the player to pick new characters (block 104, or the same character again if the player wishes instead to change symbols and/or amount of symbols picked) and the remaining portion of sequence 100 is repeated as described above (the gaming device may also change character or particular symbols selected). It should thus be appreciated that the Yes arrow from diamond 130 could alternatively extend to block 108, block 114 or block 116 or at any other suitable location.

Figure 5:
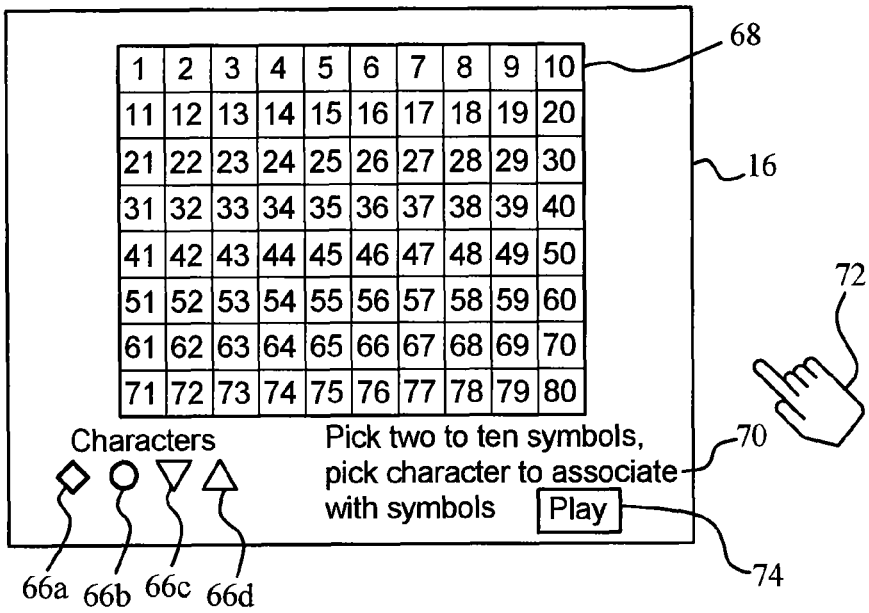

Referring now to FIGS. 5 to 10, screenshots of video monitor 16 of the gaming device illustrate various features of sequence 100 described above in connection with FIG. 4. In FIG. 5, the gaming device displays on video monitor 16 a field 68 of symbols. The gaming device provides visually and/or audibly a message 70 informing the player 72 to pick one of the characters 66*a* to 66*d* and to pick, e.g., from two to ten symbols from the field 68. Once player 72 picks a character and symbols, the player then presses a simulated play button 74 to continue the gaming sequence. Although not illustrated, the gaming device also includes prompts and buttons allowing player 72 to choose a desired wager.

Figure 6:
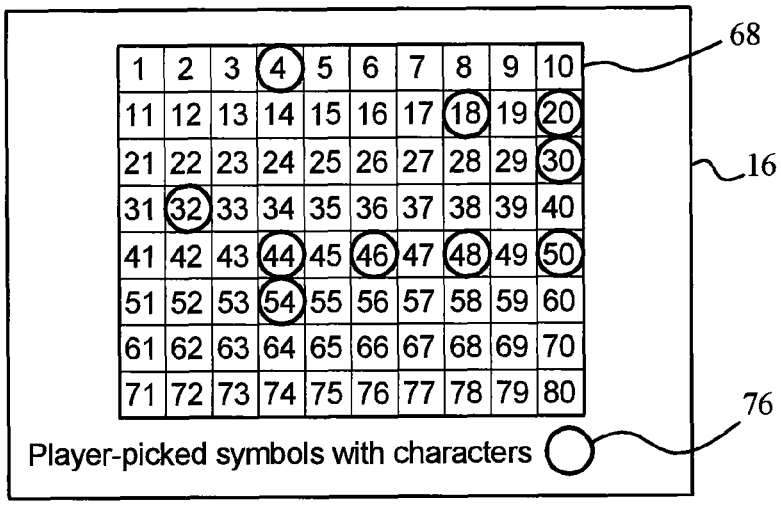

In FIG. 6, the gaming device displays on video monitor 16 the field 68 of symbols. Player 72 has selected the circle symbol 66*b* and ten numbers 4, 18, 20, 30, 32, 44, 46, 48, 50 and 54. The gaming device has accordingly associated circle 66*b* with the player's numbers and provided a corresponding visual and/or audio message 76. It should be appreciated that one or more player picked symbols or numbers and the processor picked symbols or numbers may be shared.

Figure 7:
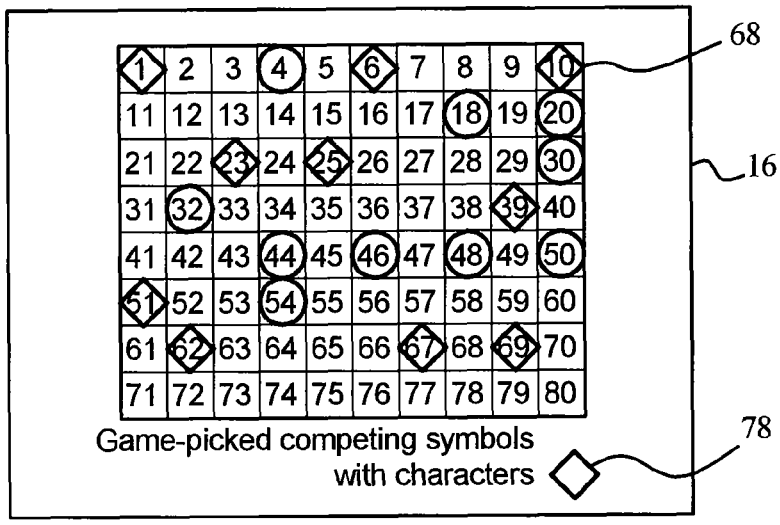

In FIG. 7, the gaming device displays on video monitor 16 the field 68 of symbols. The gaming device has selected the diamond symbol 66*a* and ten numbers 1, 6, 10, 23, 25, 39, 51, 62, 67 and 69. The numbers in an embodiment are required to be different than the numbers picked by payer 72. The gaming device has accordingly associated diamond 66a with the player's numbers and provided a corresponding visual and/or audio message 78.

In FIG. 8, the gaming device displays on video monitor 16 the field 68 of symbols. The gaming device has drawn twenty numbers from the field 68 of symbols. Here, the gaming device can draw any of the field 68 of symbols. The gaming device has randomly drawn twenty numbers 3, 4, 8, 11, 18, 30, 32, 34, 37, 39, 42, 46, 50, 54, 59, 62, 67, 73, 75 and 80. Message 80 visually and/or audibly indicates that the game-drawn symbols are marked by a slash and that the picks and draw resulted in seven hits for player 72 and three hits for the gaming device.

In FIG. 9, the gaming device displays a paytable 82 for the situation in which sequence 100 is played as a base game. Here, paytable 82 is shown for a ten player-pick game. The gaming device in one embodiment provides and shows a different primary paytable for a two, three, four, five, six, seven, eight and nine player-pick game. As seen in paytable 82, if the player has two additional hits or matches (over the number of hits or matches between the game's picks and the game-drawn symbols), the player wins $10.00 per coin bet. Three additional hits yields $50.00 per coin wagered and so on up to ten possible additional hits. Message 84 informs the player visually and/or audibly that the player's award is $100 per coin for the four additional hits.

In FIG. 10, the gaming device displays a paytable 86 for the situation in which sequence 100 is played as a bonus game. Paytable 86 is provided again for a ten player-pick game. According to message 88 and the keno paytable of FIG. 3, the player's base game win for seven hits out of ten numbers picked is $106 per coin wagered. Message 88 and paytable 86 also show that for the four additional hits the player wins $4.00 per coin wagered as a bonus or secondary award. Message 88 further informs the player that the player's total award is accordingly $110.00 per coin wagered based on seven total hits (base game) and four additional hits (bonus game). Thus, it should be appreciated that sequence 100 can be employed for a base or a bonus game.

The gaming device in one embodiment provides and shows a different bonus paytable for a two, three, four, five, six, seven, eight and nine player-pick game. As seen in paytable 86, if the player has two additional hits or matches (over the number of hits or matches between the game's picks and the game-drawn symbols), the player wins a bonus of $2.00 per coin bet. Three additional hits yields $3.00 per coin wagered and so on up to ten possible additional hits.

Figure 11:
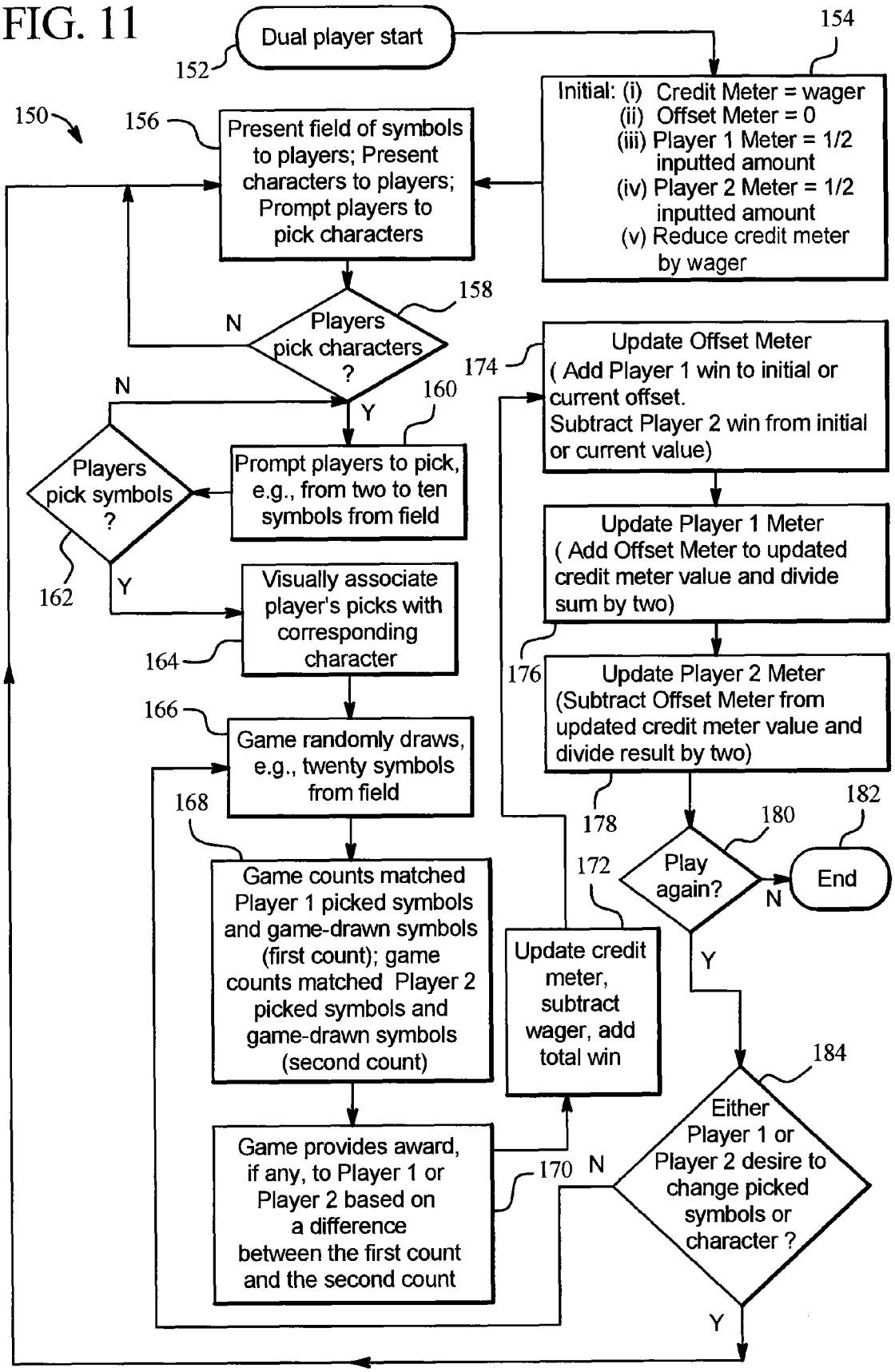
FIG. 11 is a schematic flow diagram of one embodiment of a multiple player competitive matching game.

The above-described competition matching sequence 100 is for a single player. Referring now to FIG. 11, one embodiment of a multiple player competitive matching game is illustrated by sequence 150. Although not illustrated, a simulated or electro-machine input device 18 may be provided to enable a player(s) to play a single multi-player version of the competition matching game. Upon starting sequence 150 (oval 152), the gaming device initializes various credit meters (block 154). Namely, the gaming device sets credit meter 64 to initially equal the total amount of money placed on the machine by both players. Credit meter 64 is displayed in FIGS. 1 and 3. An offset meter, which essentially keeps track of the relative success between the two players, is described below. Initially the offset meter is set to zero. The offset meter in one embodiment is not displayed. Each player has a separate credit meter (i.e., Player 1 meter, Player 2 meter), which may or may not be displayed. The player meters show a combination of the credit meter and the offset meter as described below. It should thus be appreciated that the gaming machines be located over a suitable network. The controller of the network may track the players' separate meters.

The gaming device presents a field of symbols to both players, for example the eighty numbers shown in FIGS. 1 and 3 (block 156). The gaming device also presents a plurality of characters to both players, one of which each player chooses to associate with that player's picks. Examples of characters 66*a* to 66*d* are shown and described in connection with FIG. 5. The gaming device prompts the players visually and/or audibly to each pick one of the characters for association with that player's picks (block 156).

The gaming device waits until each player picks a character before proceeding with the rest of sequence 100 (diamond 158). After each player picks a character, the gaming device prompts the players to each pick, e.g., two to ten from field of eighty symbols (block 160).

The gaming device waits until the players each pick their symbols before proceeding with the rest of sequence 100 (diamond 162). After the players each pick their respective symbols, the gaming device visually associates each player's character with the picked symbols (block 164). The characters as before may be any type of color, symbol, person, place, animal, caricature, cartoon figure, etc. (characters may be the same, e.g., all the same color, or different but related, e.g., players on the same sports team). In an embodiment, display 16 shows each player's characters behind or combined with the player's respective symbols.

Unlike the single player sequence, the gaming device here does not pick one of the characters to associate with the gaming devices picks. Instead, the players play against each other. In this sequence 150, the gaming device makes one random selection of certain ones of the symbols, namely, in which it draws, e.g., twenty symbols from the field of eighty symbols, for the purpose of matching with each player's picks (block 166). It should be appreciated that the gaming device may make this random determination at any suitable time during sequence 150. For purposes of description, it is logical to present the random generation sequentially after each player's picks.

The gaming device makes two counts (block 168). In a first count, the gaming device counts the amount of matched Player 1-picked symbols (from block 160) and gaming device's drawn symbols (from block 166). In a second count, the gaming device counts the amount of matched Player 2-picked symbols (from block 160) and gaming device's drawn symbols (from block 166).

The competition aspect of sequence 150 is provided as a primary game. Here, either player's primary award, if any, is based on the difference between the first count and the second count. If the amount of matches (second count) between Player 2's picks of, e.g., ten numbers (from block 160), and gaming device's random draw of twenty numbers (from block 166) is more than the amount of matches (first count) between the Player 1's pick of, e.g., ten numbers (from block 160) and gaming device's random draw of twenty numbers (from block 166), Player 2 may win an award (game may have threshold difference that must be met for any award). If the amount of matches (second count) between Player 1's picks of, e.g., ten numbers (from block 160), and gaming device's random draw of twenty numbers (from block 166) is more than the amount of matches (first count) between the Player 2's pick of, e.g., ten numbers (from block 160) and device's random draw of twenty numbers (from block 166), Player 1 may win an award.

Suitable primary award paytables for ten, six and two player-picks are shown and described in connection with FIGS. 12, 13 and 14.

Next, sequence 150 of the gaming device updates the various meters. The gaming device updates the overall credit meter 64 (block 172) by (i) subtracting the total wager made by each player and (ii) adding the amount won if any to the initial or current total credit amount. The gaming device updates the offset meter (block 174) by (i) adding Player l's win to the initial or current offset amount or (ii) subtracting Player 2's win from the initial or current offset amount. The gaming device updates Player 1's meter (block 178) by adding the newly updated offset meter amount to the newly updated total credit meter and dividing that sum by 2. The gaming device updates Player 2's meter (block 178) by subtracting the newly updated offset meter amount from the newly updated total credit meter and dividing that result by 2.

Examples of the updating of the meters are discussed below in connection with FIG. 16.

After any primary award is issued to either player and the meters are updated, the gaming device prompts the players to decide whether to play again (diamond 180). If the players decide not to play again, the players cash out and the game of sequence 150 ends (as indicated by oval 182). If the players decide to play again, the gaming device prompts the players to decide whether to keep any one or more of: (i) each player's selected character; (ii) each players number of picks; and (iii) each player's actual symbols picked. Although not illustrated, the players are also allowed to adjust their wager if desired. In one embodiment, each player has to wager the same amount. In one implementation, one amount is wagered and split evenly between the players. The corresponding paytable can therefore pay in half-credits. The gaming device may alternatively require a wager of an even number of credits. Likewise, in one implementation, when a monetary amount is placed on the machine, it is split evenly between the players. The corresponding player meters may therefore be able to indicate half-credits. The gaming device may alternatively require that an even credit amount of money be placed on the machine.

If the players decide not to change any of the three game parameters listed above, the gaming device proceeds to randomly draw, e.g., twenty numbers, from the field for matching purposes (as indicated by block 166) and the remaining portion of sequence 150 is repeated as described above. If either player decides to change any of the three game parameters listed above, the gaming device proceeds to prompt the players to pick new characters (as indicated by block 156, or the same character again if the players wish instead to change symbols and/or amount of symbols picked) and the remaining portion of sequence 150 is repeated as described above.

Referring now to FIGS. 12 to 14, three different paytables are shown on video monitor 16 of the gaming device 10. Because the game of keno, for example, enables the players to pick different amounts of symbols, gaming device in essence is capable of playing X No. of different games, wherein X is the number of different amounts of picks available. For a keno game allowing the players to pick from two to ten symbols, the gaming device 10 will maintain nine different paytables. In an embodiment, each paytable leads to the same or substantially the same expected value, so that no amount of picks is advantageous relative to other amounts of picks. In other embodiments, the range of awards and volatility vary.

FIG. 12 shows a sample paytable for a pick of ten symbols. It shows a non-linear increase in pay with the top pay occurring when all ten of one player's picks yield a match and none of the ten of the other player's picks yield a match. FIG. 13 shows a sample paytable for a pick of six symbols. It shows a non-linear increase in pay with the top pay occurring when all six of one player's picks yield a match and none of the six of the other player's picks yields a match. FIG. 14 shows a sample paytable for a pick of two symbols. It shows a non-linear increase in pay with the top pay occurring when both of one player's picks yields a match and none of the two of the other player's picks yields a match. As seen, while the top award increases as the number of picks increases, the lower ends of the paytables are more advantageous for the players when they pick less symbols, leveling the expected values.

FIG. 15 shows one possible display arrangement for the multiple player competition matching game. The arrangement is provided on video monitor 16 of gaming device 10. The arrangement shows the field 68 of symbols, credit meter 64, Player 1 meter 90 and Player 2 meter 92. As seen, credit meter 64 shows the sum of Player 1 meter 90 and Player 2 meter 92. In the illustrated embodiment, the offset meter is not shown and is instead an internal meter.

FIG. 16 shows four examples or game states, which helps to explain the initiation and meter updating steps of sequence 150. In an initiation step, after two players each wager $10 (or single wager of $20) on a $1 per coin machine, credit meter 64 reads twenty credits, the offset meter reads zero. Player 1 meter reads: (credit+offset)/2 or (20+0)/2 or ten credits. Player 2 meter reads: (credit−offset)/2 or (20−0)/2 or ten credits.

In game play #1, each player wagers two credits (four total). Neither player wins. Credit meter 64 reads (initial−wager) or (20−4) or sixteen credits. The offset meter reads zero because neither player won. Player 1 meter reads: (credit+offset)/2 or (16+0)/2 or eight credits. Player 2 meter reads: (credit−offset)/2 or (16−0)/2 or eight credits.

In game play #2, each player wagers two credits (four total). Player 1 receives two more hits than Player 2, winning five credits per coin or $10 according to, e.g., the ten pick paytable of FIG. 12. Credit meter 64 reads (current−wager+win) or (16−4+10) or twenty-two credits. The offset meter reads (current+win, because Player 1 won) or (0+10) or ten credits. Player 1 meter reads: (credit+offset)/2 or (22+10)/2 or sixteen credits. Player 2 meter reads: (credit−offset)/2 or (22−10)/2 or six credits.

In game play #3, each player again wagers two credits (four total). Player 2 receives three more hits than Player 1, winning twelve credits per coin or $24 according to, e.g., the ten pick paytable of FIG. 12. Credit meter 64 reads (current−wager+win) or (22−4+24) or forty-two credits. The offset meter reads (current−win) because Player 2 won (or (10−24) or negative fourteen credits. Player 1 meter reads: (credit+offset)/2 or (42+−14)/2 or fourteen credits. Player 2 meter reads: (credit−offset)/2 or (42−−14)/2 or twenty-eight credits.

The meters are updated in the above-described manner until the players cash out. Gaming device may payout separately to each player according to the player meters. In an embodiment, the gaming device employs a suitable ticket wagering system. Here, the gaming device can issue two separate bar-coded tickets coding the amounts of money according to the player meters.

Figure 17:
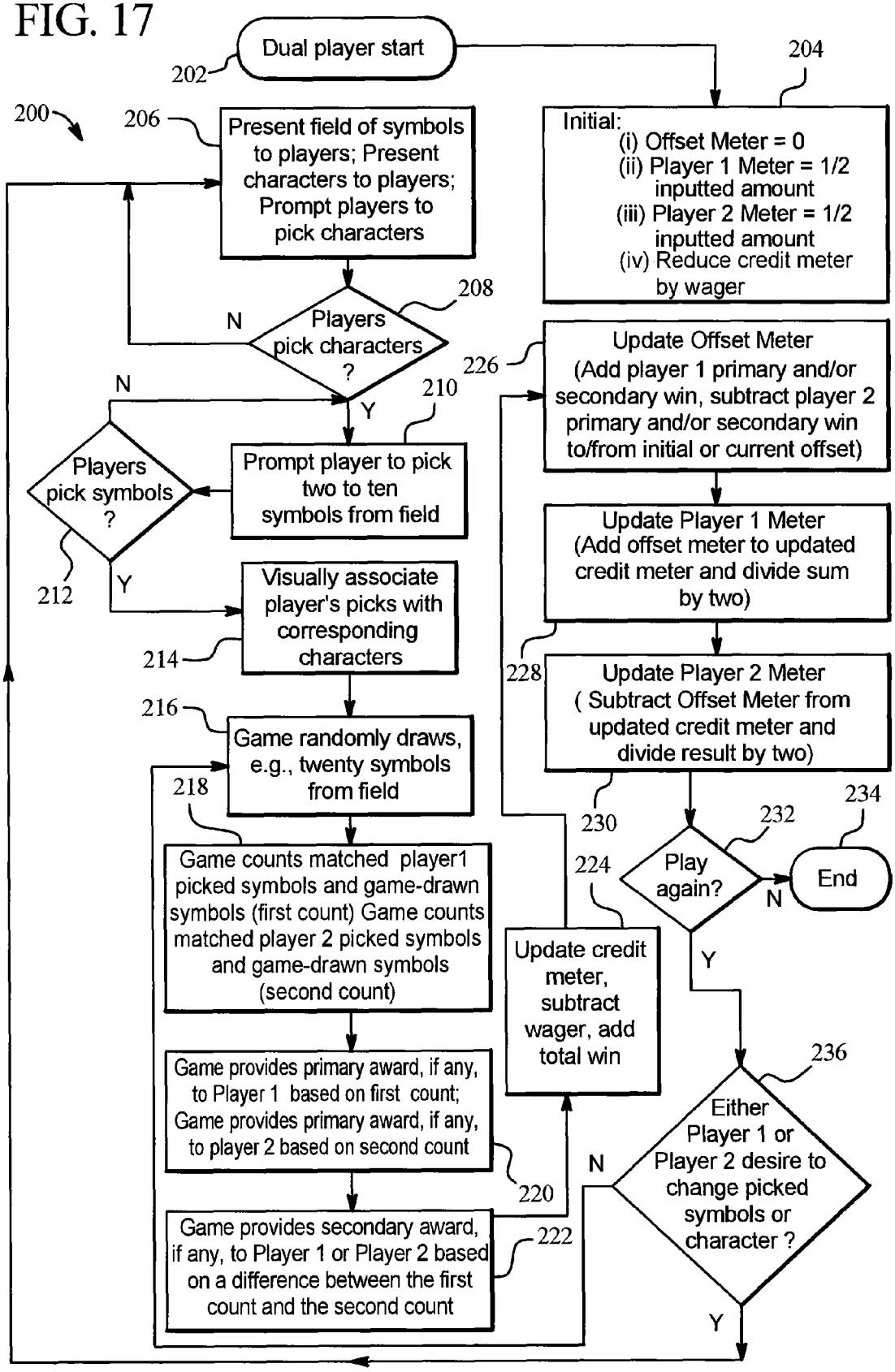
FIG. 17 is a schematic flow diagram of another embodiment of a multiple player competitive matching game.

Referring now to FIG. 17, an alternative multiple player competition matching sequence is illustrated by sequence 200. Here, the primary difference is that the multiple player matching game is played and paid as a secondary game to a primary game of keno.

Sequence 200 operates the same in many respects as sequence 150. Upon starting sequence 250 (oval 252), the gaming device initializes various credit meters (block 204). Again, the gaming device sets credit meter 64 to initially equal the total amount of money placed on the machine by both players. The offset meter is set initially to zero. The player meters each show one-half the total wager.

The gaming device presents the field of symbols and characters to both players and prompts the players visually and/or audibly to each pick one of the characters for association with that player's picks (block 206).

The gaming device waits until each player picks a character before proceeding with the rest of sequence 100 (diamond 208). After each player picks a character, the gaming device prompts the players to each pick, e.g., from two to ten symbols from the field of eighty symbols (block 160).

The gaming device waits until the players each pick their symbols before proceeding with the rest of sequence 100 (diamond 212). After the players each pick their respective symbols, the gaming device visually associates each player's character with the picked symbols (block 214).

In sequence 200, the players again play against each other. The gaming device draws, e.g., twenty symbols from the field of eighty symbols, for the purpose of matching with each player's picks (block 216). It should be appreciated that the gaming device may make the this random determination at any suitable time during sequence 200.

The gaming device again makes two counts (block 218). In a first count, the gaming device counts the amount of matched Player 1-picked symbols (from block 210) and gaming device's drawn symbols (from block 216). In a second count, the gaming device counts the amount of matched Player 2-picked symbols (from block 210) and gaming device's drawn symbols (from block 216).

In sequence 200, the competition aspect of the gaming device is provided as a secondary or bonus game played in addition to a base game, such as keno. Here, the gaming device provides a primary award to each player if any based solely on the first and seconds count, without comparison, for example, according to the rules and paytable of keno (block 220), e.g., via the paytable discussed above and shown in FIGS. 1 and 3. For example, if either of the players picks ten numbers (from block 210), six of which match with six of gaming device's twenty drawn numbers (from block 216), the corresponding player has a base game win of $18.00 times the player's bet.

The gaming device provides a bonus or secondary award, if any, based on a difference between the first and second counts (block 222). For example, if Player 1 picks ten numbers (from block 210), six of which match with six of gaming device's twenty drawn numbers (from block 216), the player wins as described above. If Player 1 receives more matches than Player 2, Player 1 receives an additional bonus award according to a suitable paytable.

In steps 224, 226, 228 and 230, method or sequence 200 updates the credit meter, offset meter and player meters as described above. In doing so, the credit meter and offset meters take into account all base and secondary awards issued to either Player 1 or Player 2.

As before, after a primary and/or secondary award is issued to either player and the meters are updated, the gaming device prompts the players to decide whether to play again (diamond 232). If the players decide not to play again, the players cash out and the game of sequence 150 ends (oval 234). If the players decides to play again, the gaming device prompts the players to decide whether to keep any one or more of: (i) each player's selected character; (ii) the players' number of picks; and (iii) each players actual symbols picked.

Although not illustrated, the players are also allowed to adjust their wager if desired. In one embodiment each player has to wager the same amount, leading to half-credits or a wager requirement of an even number of credits. Likewise, in one implementation, when a monetary amount is placed on the machine, it is split evenly between the players. The corresponding player meters may therefore be able to indicate half-credits. The gaming device may alternatively require that an even credit amount of money be placed on the machine.

If the players decide not to change any of the three game parameters listed above, the gaming device proceeds to randomly draw, e.g., twenty numbers from the field for matching purposes (as indicated by block 216) and the remaining portion of sequence 200 is repeated as described above. If either player decides to change any of the three game parameters listed above, the gaming device proceeds to prompt the players to pick new characters (as indicated by block 206, or the same character again if the players wish instead to change symbols and/or amount of symbols picked) and the remaining portion of sequence 200 is repeated as described above.

The secondary multiple player matching game of sequence 200 may be provided with each primary game, at randomly selected times, as a bonus based on another primary game outcome, as a separate wagerable game, and so on. In a further alternative embodiment, if one player achieves a threshold difference, e.g., three matches based on a ten symbol pick by the player, the gaming device displays and plays a secondary or bonus game (e.g., theme-based or character based) leading to a bonus award. Here, the bonus game may be structured to give the player better odds to win more based on how well the player performed. For example, the player gets more picks of award selections for having four more matches versus three.

Matching Game With Bonus Feature

Referring now to FIGS. 18 to 22, a matching game with a bonus feature is illustrated. Again, for purposes of illustration, the matching game is shown as a keno game described in connection with FIGS. 1 to 3. It should be appreciated, however, that the bonus feature shown and described below may be combined with other matching games, such as bingo, lotto, etc.

Figure 18:
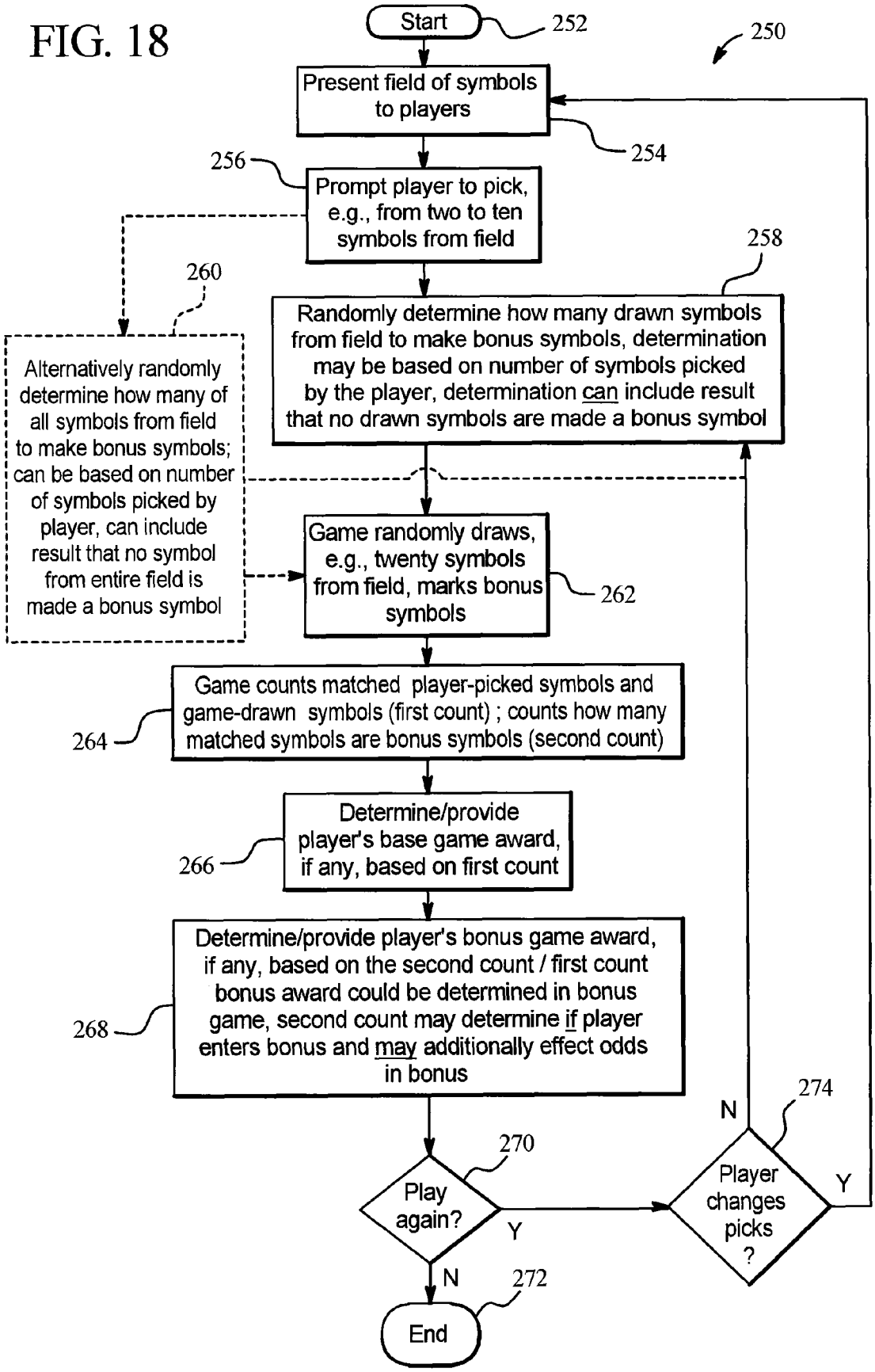
FIG. 18 is a schematic flow diagram of one embodiment of a matching game having a bonus feature.

FIG. 18 illustrates a sequence 250. Upon starting sequence 250 (oval 252), the gaming device presents a field of symbols, for example the eighty numbers shown in FIGS. 1 and 3 (as indicated by block 254). The gaming device prompts the player to pick symbols from the field of symbols (as indicated by block 256). In the illustrated keno embodiment, the player in one implementation is enabled to pick from two to ten symbols from a field of eighty symbols.

After the player picks the symbols, the gaming device can proceed in one of two implementations. In one implementation (as indicated by block 258), the gaming device randomly determines how many processor drawn symbols (done in connection block 262) from the field to make bonus symbols. The random determination can be made based on how many symbols that the player picks. For example, the gaming device can make the random determination according to ranges of possibilities shown in the following table:

| # of Player picks | range of possible bonus symbols |
|---|---|
| 2 | (1 to 3) |
| 3 | (1 to 5) |
| 4 | (2 to 5) |
| 5 | (2 to 6) |
| 6 | (2 to 7) |
| 7 | (3 to 7) |
| 8 | (12 to 22) |
| 9 | (13 to 13) |
| 10 | (14 to 24) |

As seen below, in one embodiment, the more symbols the player picks, the more bonus symbols the player needs for a bonus award. So as to not make any one amount of player picks advantageous over any other, the ranges are scaled, for example, as above so that each amount of player picks has at least substantially the same expected value bonus award. Although not seen in the table, any one or more or all of the ranges may include a zero result in which no drawn symbols are made bonus symbols. Alternatively, the bonus feature is provided intermittently, randomly, upon a certain base game event, upon a certain wager or after a certain amount wagered or lost.

Alternatively, the gaming device determines randomly how many symbols are bonus symbols from the full field of, e.g., eighty symbols, and not just from the drawn symbols (as indicated by alternative block 260). Again, the random determination can be made based on how many symbols that the player picks. For example, the gaming device can make the random determination according to the ranges of possibilities shown in the following table:

| # of Player picks | range of possible bonus symbols |
|---|---|
| 11 | (5 to 15) |
| 12 | (6 to 17) |
| 13 | (7 to 19) |
| 14 | (8 to 21) |
| 15 | (9 to 23) |
| 16 | (10 to 25) |
| 17 | (11 to 27) |
| 18 | (12 to 29) |

In one embodiment, the more symbols the player picks, the more bonus symbols the player needs for a bonus award. So as to not make any one amount of player picks advantageous over any other, the ranges are scaled, for example, as above so that each amount of player picks has at least substantially the same expected value a bonus award. The ranges are bigger than for the case above in which the symbols are all drawn symbols because there is no guarantee that any symbol designated as a bonus symbol will be drawn by the game. Any one or more or all of the ranges may include a zero result in which no drawn symbols are made to be bonus symbols. Alternatively, the bonus feature is provided intermittently, randomly, upon a certain base game event, upon a certain wager or after a certain amount wagered or lost.

Regardless of whether the bonus symbol determination is made based only on drawn symbols (as indicated by block 258) or the entire field of symbols (as indicated by block 260), the gaming device draws, e.g., twenty symbols from the field of eighty symbols, for the purpose of matching with the player's picks (as indicated by block 262). It should be appreciated that the gaming device may make the draw at any suitable time during sequence 250. For purposes of description, it is logical to present the draw sequentially after the player's picks.

The gaming device makes the counts in a first count, the gaming device counts (as indicated by block 264) the amount of matched player-picked symbols (from block 256) and gaming device's drawn symbols (from block 264). In a second count, the gaming device counts how many of the matched player-picked and game-drawn symbols that are bonus symbols (block 264).

In the next step, the gaming device provides a base game award to the player if earned (as indicated by block 266). The gaming device provides the base game award to the player based on the first count, for example, according to the rules and paytable of keno (as indicated by block 220), e.g., via the paytable discussed above and shown in FIGS. 1 and 3. For example, if either of the players picks ten numbers (from block 256), six of which match with six of gaming device's twenty drawn numbers (from block 262), the corresponding player has a base game win of $18.00 times the player's bet.

The gaming device provides a bonus or secondary award, if any, based on the second count or a combination of the first and second counts (as indicated by block 268). The secondary is provided in one embodiment only if the number hits involving bonus symbols exceeds the number of hits involving non-bonus symbols. The second count can be directly related to the secondary award, e.g., according to a paytable that pays more for more bonus symbol hits. The second count can alternatively be indirectly related to the secondary award, e.g., threshold amount of bonus symbol hits triggers separate bonus game that pays according to its own paytable, independently of the amount of bonus symbol hits. Further alternatively, the bonus game can also be played or paid based on the amount of bonus symbol hits. For example, the player may obtain more tries in the bonus game for obtaining more bonus symbol hits. The bonus game paytable may be more favorable when obtaining more bonus symbol hits.

After a primary and/or secondary award is issued to the player, gaming device prompts the player to decide whether to play again (as indicated by diamond 270). If the player decides not to play again, the player cashes out and the game of sequence 250 ends (as indicated by oval 272). If the player decides to play again, the gaming device prompts the players to decide whether to keep any one or more of: (i) the players' number of picks; and (ii) the actual symbols picked.

Although not illustrated, the player is also allowed to adjust the wager if desired. If the player decides not to change any of the game parameters listed above, gaming device proceeds to randomly draw, e.g., twenty numbers from the field for matching purposes (as indicated by block 258) and the remaining portion of sequence 250 is repeated as described above. If the player decides to change any of the game parameters listed above, the gaming device proceeds to prompt the player to pick new symbols and/or amount of symbols picked (as indicated by blocks 254 and 256) and the remaining portion of sequence 250 is repeated as described above.

Figure 19:
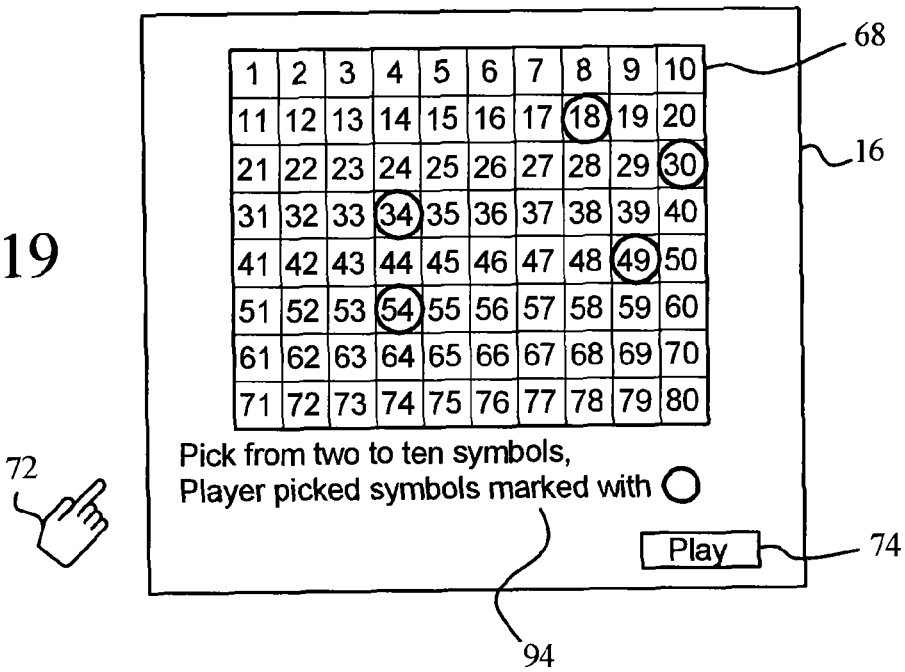
FIGS. 19 to 22 are elevation views of a display device of the gaming device illustrating various aspects of the example of the sequence of FIG. 18.

Referring now to FIGS. 19 to 22, screenshots of video monitor 16 of gaming device 10 illustrate various features of sequence 250 described above in connection with FIG. 18. In FIG. 19, the gaming device displays on video monitor 16 the field 68 of symbols. The gaming device provides visually and/or audibly a message 94 informing the player 72 to pick, e.g., from two to ten symbols from the field 68. Message 94 also informs the player that the player-picked symbols are marked with an "O." Once player 72 picks a desired number of symbols, the player then presses a simulated play button 74 to continue the gaming sequence. Although not illustrated, the gaming device also includes prompts buttons allowing the player to choose a desired wager.

Figure 20:
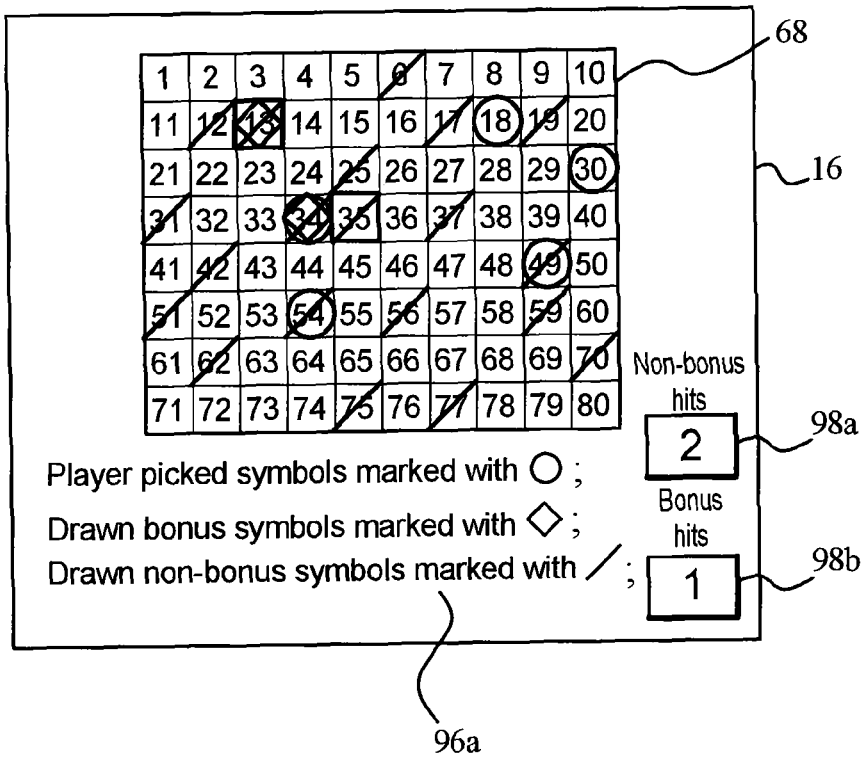

In FIG. 20, the bonus symbols are selected from the game-drawn symbols. Player 72 has selected five numbers 18, 30, 34, 49 and 54. The gaming device has also randomly drawn twenty numbers 6, 12, 13, 17, 19, 25, 31, 34, 35, 37, 42, 49, 51, 54, 56, 59, 62, 70, 75 and 77. Of those symbols, symbols 18 and 34 are randomly made to be bonus symbols. Message **96*a* visually and/or audibly indicates that non-bonus game-drawn symbols are marked by a slash, bonus game-drawn symbols are marked by a diamond. Meter 98*a* shows that the player has achieved two non-bonus hits (numbers 49 and 54, with slash and circle). Meter 98b shows that the player has achieved one bonus hit (number 34, with diamond, slash and circle). Alternatively, the game device provides a bonus for symbols like number 13 in FIG. 20**, which are drawn and bonus but not player-picked.

In one embodiment, the player wins a bonus award (or goes to a bonus game) for achieving more bonus hits than non-bonus hits. Here, the player has two non-bonus hits and only one bonus hit, and would not receive a bonus award. The player would still achieve a base game award for hitting on three out of five picks. Alternatively, the player wins a bonus award for having any bonus hits and wins more for achieving more bonus hits.

Figure 21:
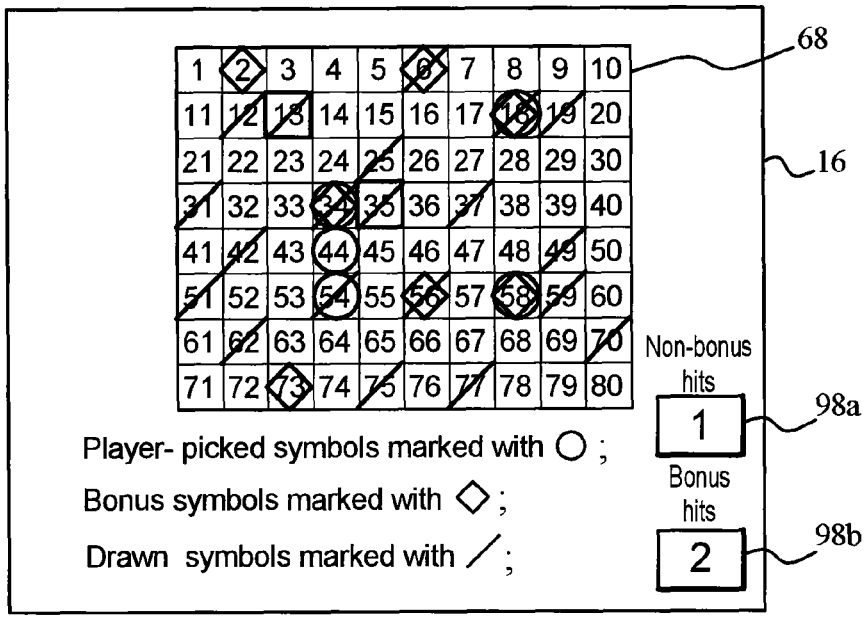

In FIG. 21, the gaming device displays another embodiment on video monitor 16 the field 68 of symbols. In this embodiment, the bonus symbols are selected from the full field 68 of game-drawn symbols and are not necessarily game-drawn symbols. The player has selected the five numbers 18, 34, 44, 54 and 58. The gaming device has also randomly drawn twenty numbers 6, 12, 13, 18, 19, 25, 31, 34, 35, 37, 42, 49, 51, 54, 56, 59, 62, 70, 75 and 77. The message visually and/or audibly indicates that player-picked symbols are marked with a circle, bonus symbols (not necessarily game-drawn symbols) are marked with a diamond, and game-drawn symbols are marked with a slash. Here, for example, the numbers 2, 58 and 73 are determined randomly to be bonus symbols but are not game-drawn symbols. Also, number 58 is picked by the player and determined randomly to be a bonus symbol, but is not a game-drawn symbol. Meter **98*a* shows that the player has achieved one non-bonus hit (number 54). Meter 98*b*** shows that the player has achieved two bonus hits (numbers 18 and 34).

Figure 22:
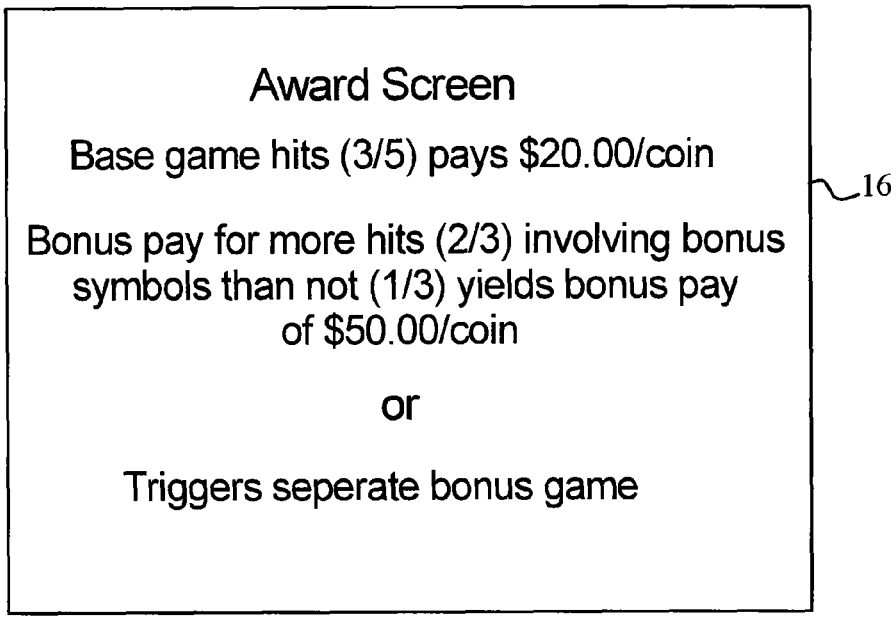

FIG. 22 shows a paytable on screen 16 of the gaming device for the example of FIG. 21. Here, the paytable is shown for a five player-pick game. As seen in the paytable, the player wins a base game award of $20 per coin for hitting on a total of three out of five picks. The player wins a bonus award of $50 per coin for achieving more bonus hits (two) than non-bonus hits (one). Alternatively, the player wins a bonus award for having any bonus hits and wins more for achieving more bonus hits. Further alternatively, the player wins a bonus award for the case of number 58, in which the player's pick is made a bonus symbol, but in which the symbol is not drawn by the gaming device. Still further alternatively, the gaming device provides a bonus for symbols like number 6, which are drawn and determined randomly to be bonus but are not player-picked.

It should thus be appreciated that the above disclosure generally addresses various situations where the paytable provides award amounts in accordance with the difference in the number of hits in the two sets of picks. In the various embodiments, this can be provided as the base award or as a bonus award over any base award.

It should be appreciated that other approaches of determining and providing awards may be implemented. For instance, the difference in the number of hits in the two sets can be used to determine a multiplier value that is applied to a base award, a bonus award or both. The multiplier existence/value can be based upon any suitable relationship of the two hit counts: greater, lesser, or equal.

The difference in number of hits can also serve to trigger a second screen bonus feature, free games, fever mode or any other suitable bonus outcome or award. The feature can have higher award potentials when specified characteristics of the differences exist (e.g., higher awards for being much higher, much lower, or closer in the number of hits). The award can also be a multiple of the difference between the amounts.

It should also be appreciated that the various embodiments of the present disclosure could be employed with a single player (as described above) or with multiple players. For instance, the different sets can be picked by different players, or a same picked set can be used for multiple players.

In another alternative, the base game can use the two sets of picks combined. For example, if there are 4 picks in each set, the base game is based upon the number of hits on those 8 picks. The difference in the number of hits can then go to either alter the award (such as a bonus award, multiplier, etc.) or determine which player gets the award.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device operable under control of at least one processor, said gaming device comprising:

a display device controlled by the at least one processor;

an input device in communication with the at least one processor;

a memory device in communication with the at least one processor, said memory device storing instructions which, when executed by the at least one processor, cause the at least one processor, for a single play of a game, to:

(i) cause the display device to display a plurality of selections;

(ii) cause a first selection of a first subset of the plurality of selections;

(iii) cause a second selection of a second subset of the plurality of selections;

(iv) cause a third selection of a third subset of the plurality of selections, the first selection, the second selection, and the third selection each being independent of one another;

(v) compare said first subset of the plurality of selections to said third subset of said plurality of selections;

(vi) compare said second subset of the plurality of selections to said third subset of said plurality of selections;

(vii) determine a first number based on said comparison of said first subset to said third subset, said first number being based on a quantity of like selections between the first subset and the third subset;

(viii) determine a second number based on said comparison of said second subset to said third subset, said second number being based on a quantity of like selections between the second subset and the third subset;

(ix) determine if said first number is greater than said second number; and (x) if said first number is greater than said second number:

(a) cause the display device to display an indication that a first award is to be provided to a player, and (b) cause said first award to be provided to the player.

2. The gaming device of claim 1, wherein the first award includes a play of a bonus game.

3. The gaming device of claim 1, wherein the first award includes a credit amount.

4. The gaming device of claim 1, wherein the first award includes a credit modifier.

5. The gaming device of claim 1, wherein the input device enables the player to provide at least one input to select the first subset of the plurality of selections.

6. The gaming device of claim 5, wherein the instructions, when executed by the at least one processor, cause the at least one processor to randomly select the second subset of the plurality of selections.

7. The gaming device of claim 5, wherein the player is a first player, and wherein the memory device stores instructions which, when executed by the at least one processor, cause the at least one processor to cause the second selection of the second subset of the plurality of selections by receiving data indicative of the second selection from a second player.

8. The gaming device of claim 7, wherein the memory device stores instructions which, when executed by the at least one processor, cause the at least one processor to, if said first number is less than said second number, cause the first award to be provided to the second player.

9. The gaming device of claim 1, wherein the instructions, when executed by the at least one processor, cause the at least one processor to randomly select the second subset of the plurality of selections.

10. The gaming device of claim 1, wherein the memory device stores instructions which cause the at least one processor to, if the first number is equal to a predetermined number: (a) cause the display device to display an indication that a second award is to be provided to the player and (b) cause the second award to be provided to the player.

11. A method of operating a gaming device to provide a single play of a game, said method comprising:

(i) causing at least one display device to display a plurality of selections;

(ii) enabling a first selection of a first subset of the plurality of selections;

(iii) enabling a second selection of a second subset of the plurality of selections;

(iv) enabling a third selection of a third subset of the plurality of selections, the first selection, the second selection, and the third selection each being independent of one another;

(v) comparing said first subset of the plurality of selections to said third subset of said plurality of selections;

(vi) comparing said second subset of the plurality of selections to said third subset of said plurality of selections;

(vii) determining a first number based on said comparison of said first subset to said third subset, said first number being based on a quantity of like selections between the first subset and the third subset;

(viii) determining a second number based on said comparison of said second subset to said third subset, said second number being based on a quantity of like selections between the second subset and the third subset;

(ix) determining if said first number is greater than said second number; and (x) if said first number is greater than said second number:

(a) causing the at least one display device to display an indication that a first award is to be provided to a player, and (b) providing said first award to the player.

12. The method of claim 11, wherein the first award includes a play of a bonus game.

13. The method of claim 11, wherein the first award includes a credit amount.

14. The method of claim 11, wherein the first award includes a credit modifier.

15. The method of claim 11, which includes enabling the player to select the first subset of the plurality of selections.

16. The method of claim 15, which includes randomly selecting the second subset of the plurality of selections.

17. The method of claim 15, wherein the player is a first player, and which includes enabling the second selection of the second subset of the plurality of selections to be made by a second player.

18. The method of claim 17, which includes, if said first number is less than said second number, causing the first award to be provided to the second player.

19. The method of claim 11, which includes randomly selecting the second subset of the plurality of selections.

20. The method of claim 11, which includes, if said first number is equal to a predetermined number, (a) causing the at least one display device to display an indication that a second award is to be provided to the player, and (b) providing the second award to the player.

21. A gaming system comprising:

a controller programmed to operate with a first gaming device and a second gaming device to:

(a) cause a display of a plurality of symbols on a first display device of the first gaming device and on a second display device of the second gaming device;

(b) enable a first player at the first gaming device to select a first set of the plurality of displayed symbols;

(c) enable a second player at the second gaming device to independently select a second set of the plurality of displayed symbols;

(d) cause a random selection of a third set of the plurality of displayed symbols, the random selection of the third set of symbols being independent of the first set of symbols and the second set of symbols;

(e) cause a comparison of said first set of symbols to said third set of symbols, said comparison determining a first quantity of matching symbols;

(f) cause a comparison of said second set of symbols to said third set of symbols, said comparison determining a second quantity of matching symbols;

(g) if the first quantity of matching symbols is greater than the second quantity of matching symbols, cause the first gaming device to provide an award to the first player; and (h) if the second quantity of matching symbols is greater than the first quantity of matching symbols, cause the second gaming device to provide the award to the second player.

22. The gaming system of claim 21, wherein the award includes at least one selected from the group consisting of: a play of a bonus game, a credit amount, and a credit modifier.

23. The gaming system of claim 21, which includes:

if the first quantity of matching symbols exceeds a predetermined number, causing the first gaming device to provide a bonus award to the first player; and if the second quantity of matching symbols exceeds the predetermined number, causing the second gaming device to provide the bonus award to the second player.

24. The gaming system of claim 23, wherein the bonus award includes an amount based on a difference between the first quantity of matching symbols or the second quantity of matching symbols and the predetermined number.

25. The gaming system of claim 21, wherein the award includes an amount based on the difference between the first quantity of matching symbols and the second quantity of matching symbols.

* * * * *

UNITED STATES PATENT AND TRADEMARK OFFICE

CERTIFICATE OF CORRECTION

PATENT NO. : 7,901,282 B2
APPLICATION NO. : 11/457707
DATED : March 8, 2011
INVENTOR(S) : Cannon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 653 days.

Signed and Sealed this
Nineteenth Day of July, 2011

David J. Kappos

David J. Kappos
*Director of the United States Patent and Trademark Office*